US011303076B2

(12) United States Patent
Haga et al.

(10) Patent No.: US 11,303,076 B2
(45) Date of Patent: Apr. 12, 2022

(54) COAXIAL ELECTRICAL CONNECTOR

(71) Applicant: Hirose Electric Co., Ltd., Kanagawa (JP)

(72) Inventors: Yujin Haga, Kanagawa (JP); Masahiro Tsuchida, Kanagawa (JP); Tsubasa Kaneko, Kanagawa (JP)

(73) Assignee: Hirose Electric Co., Ltd., Yokohama (JP)

( * ) Notice: Subject to any disclaimer, the term of this patent is extended or adjusted under 35 U.S.C. 154(b) by 0 days.

(21) Appl. No.: 17/172,585

(22) Filed: Feb. 10, 2021

(65) Prior Publication Data

US 2021/0249828 A1 Aug. 12, 2021

(30) Foreign Application Priority Data

Feb. 10, 2020 (JP) ..... JP2020-020416

(51) Int. Cl.
*H01R 24/40* (2011.01)
*H01R 13/42* (2006.01)
*H01R 103/00* (2006.01)

(52) U.S. Cl.
CPC ..... *H01R 24/40* (2013.01); *H01R 13/42* (2013.01); *H01R 2103/00* (2013.01)

(58) Field of Classification Search
CPC ..... H01R 2103/00; H01R 9/05; H01R 24/40; H01R 24/50; H01R 13/42
USPC ..... 439/582, 585
See application file for complete search history.

(56) References Cited

U.S. PATENT DOCUMENTS 6,340,312 B1 * 1/2002 Ko ..... H01R 9/0518 439/582
6,371,806 B1 * 4/2002 Ko ..... H01R 9/0518 439/585
6,447,335 B1 * 9/2002 Ko ..... H01R 9/0518 439/582
6,572,407 B1 * 6/2003 Ko ..... H01R 9/0518 439/582
7,758,377 B2 * 7/2010 Maruyama ..... H01R 13/6277 439/582
7,806,726 B2 * 10/2010 Chen ..... H01R 9/0518 439/582
2008/0293299 A1 * 11/2008 Liao ..... H01R 13/11 439/582
2012/0135637 A1 * 5/2012 Chang ..... H01R 9/0518 439/585

(Continued)

FOREIGN PATENT DOCUMENTS

JP 2018-006012 A 1/2018

*Primary Examiner* — Gary F Paumen
(74) *Attorney, Agent, or Firm* — Procopio, Cory, Hargreaves & Savitch LLP

(57) ABSTRACT

An outer conductor 70 has arm-shaped portions 74 that extend from a mating body portion 73, the arm-shaped portions 74 are of a curved shape and have front contact portions 74B-2 enabled to contact the mating body portion 73 and rear contact portions 74B-1 enabled to contact cover plate portions 76, and bringing the front contact portions 74B-2 into contact with the mating body portion 73 while bringing the rear contact portions 74B-1 into contact with the cover plate portions 76 places the counterpart outer conductor and the cover plate portions 76 in electrical communication via the mating body portion 73, front contact portions 74B-2, and rear contact portions 74B-1.

19 Claims, 23 Drawing Sheets

(56) References Cited

U.S. PATENT DOCUMENTS

| | | | | |
|---|---|---|---|---|
| 2012/0142211 | A1* | 6/2012 | Kubo | H01R 9/0518<br>439/426 |
| 2013/0196540 | A1* | 8/2013 | Sasaki | H01R 24/38<br>439/582 |
| 2014/0213107 | A1* | 7/2014 | Himi | H01R 4/185<br>439/585 |
| 2015/0064967 | A1* | 3/2015 | Guo | H01R 4/023<br>439/585 |

* cited by examiner

COAXIAL ELECTRICAL CONNECTOR

CROSS-REFERENCE TO RELATED APPLICATIONS

This application claims priority to Japanese Patent Application No. 2020-020416, filed Feb. 10, 2020, the contents of which are incorporated herein by reference in its entirety for all purposes.

BACKGROUND

Technical Field

This invention relates to a coaxial electrical connector to which the front end portion of a cable extending in a forward-backward direction is connected and which is plugged into and unplugged from a counterpart connector such that the direction of plugging and unplugging is the axial direction of the coaxial connector perpendicular to the forward-backward direction.

Related Art

Well-known examples of such coaxial electrical connectors include the plug connector disclosed in Patent Document 1 ("coaxial cable connector" in Patent Document 1; the terms used in Patent Document 1 are shown in parentheses below). The plug connector of Patent Document 1 is adapted to be plugged into and unplugged from a receptacle connector serving as a counterpart connector mounted to a circuit board such that the direction of plugging and unplugging is an up-down direction perpendicular to the mounting face of the circuit board. Said plug connector, which is connected to the front end portion of a coaxial cable extending in a forward-backward direction parallel to the mounting face of the circuit board, is matingly connected to the receptacle connector from above.

The plug connector is provided with a plug terminal (terminal) serving as an inner conductor that has a pair of resilient contact pieces (contact portions) that extend in the up-down direction, an insulative plug housing (housing) that secures said plug terminals in place, and a plug shell (outer conductor shell) that serves as an outer conductor accommodating said plug housing.

The plug shell, which is made by bending a metal sheet member in the through-thickness direction, has a planar plate portion (housing accommodating portion) that extends in the forward-backward direction, a mating body portion (tubular portion) that is located within the bounds of the front half of said plate portion and rises from said plate portion, cover plate portions (core wire crimping portions) that are located rearwardly in a spaced relationship with respect to said mating body portion and extend from the opposite lateral edges of the plate portion, and cable retaining portions (outer conductor crimping portions) that are coupled to the rear end of the plate portion and are located rearwardly of the cover plate portions. The mating body portion encloses the resilient contact pieces of the plug terminal from the front and from the sides. The cover plate portions cover a junction section between the core wire of the cable and the plug terminal, and, as a result of being flexurally deformed, indirectly secure the junction section in place through the medium of a portion of the plug housing. The cable retaining portions are crimped at a location rearward of the cover plate portions, thereby directly securing the shield wire of the cable (outer conductor) in place.

The receptacle connector, i.e., the counterpart connector, has: a receptacle terminal (terminal) serving as an inner conductor that has a contact shaft portion (contact portion) extending in the up-down direction, a receptacle shell (outer conductor shell) serving as an outer conductor that has a tubular portion (tube portion) enclosing the contact shaft portion about an axis extending in the up-down direction, and an insulative plate-shaped receptacle housing (intratubular insulator and extratubular insulator) that secures the bottom end portion of the contact shaft portion and the bottom end portion of the tube-shaped portion together in place.

When the plug connector is matingly connected to the receptacle connector from above, the resilient contact pieces of the plug terminal and the contact shaft portion of the receptacle terminal are brought into contact and placed in electrical communication to enable signal transmission. In addition, when mated with each other, the mating body portion of the plug shell and the tubular portion of the receptacle shell are brought into contact and enabled for electrical communication, and shielding properties are ensured by the plug shell and the receptacle shell.

PATENT DOCUMENTS

[Patent Document 1]

Japanese Patent Application Publication No. 2018-006012.

SUMMARY

Problems to be Solved

As discussed above, in Patent Document 1, shielding properties can be ensured by bringing the mating body portion of the plug shell and the tubular portion of the receptacle shell into mating contact. However, despite being in close proximity in the forward-backward direction, the mating body portion and the cover plate portions in the plug shell are in a mutually spaced relationship, and a gap is formed between the two as discussed above. Specifically, since the mating body portion and the cover plate portions are not in direct contact, a return path (so-called return current path) that would link said mating body portion and said cover plate portions along a signal transmission path is not formed. As a result, even though the mating body portion of the plug shell and the tubular portion of the receptacle shell are mated, sufficient shielding properties may not be achieved, which leaves room for improvement in this respect.

In view of the aforesaid circumstances, it is an object of this invention to provide a coaxial electrical connector whereby sufficient shielding properties can be adequately ensured even if the mating body portion and the cover plate portions are positioned in a spaced-apart relationship in the outer conductor of the coaxial electrical connector to which a cable is connected.

Technical Solution

It is an object of the present disclosure to provide a coaxial electrical connector whereby sufficient shielding properties can be adequately ensured even if the mating body portion and the cover plate portions are positioned in a spaced-apart relationship in the outer conductor of the coaxial electrical connector to which a cable is connected. In accordance with the invention, the above-described problem is solved by the coaxial electrical connectors according to the following inventions 1 through 5.

The coaxial electrical connector according to the first invention is a coaxial electrical connector to which the front end portion of a cable extending in a forward-backward direction is connected and which is plugged into and unplugged from a counterpart connector such that the direction of plugging and unplugging is the axial direction of the coaxial connector perpendicular to the forward-backward direction, said connector comprising an inner conductor having an internal contact portion that extends in the direction of plugging and unplugging and is enabled to contact a counterpart inner conductor provided in the counterpart connector, a dielectric body that secures the inner conductor in place, and an outer conductor that accommodates the dielectric body, with the outer conductor having a mating body portion that encloses the internal contact portion about an axis extending in the direction of plugging and unplugging and is enabled for mating contact with a counterpart outer conductor provided in the counterpart connector, and cover plate portions that cover a junction section between the inner conductor and the cable at a location rearward of said mating body portion.

Such a coaxial electrical connector, in the first invention, is characterized in that the outer conductor has arm-shaped portions that extend from the mating body portion, the arm-shaped portions are of a curved shape and have front contact portions enabled to contact the mating body portion and rear contact portions enabled to contact the cover plate portions, and bringing the front contact portions into contact with the mating body portion while bringing the rear contact portions into contact with the cover plate portions places the counterpart outer conductor and the cover plate portions in electrical communication via the mating body portion, front contact portions, and rear contact portions.

In the first invention, the mating body portion of the outer conductor is adapted to be in mating contact with the counterpart outer conductor while the front contact portions of the arm-shaped portions are adapted to contact the mating body portion and the rear contact portions of said arm-shaped portions are adapted to contact the cover plate portions. In other words, since the arm-shaped portions are located between the mating body portion and the cover plate portions, the gap that was conventionally formed between the mating body portion and the cover plate portions is covered by the arm-shaped portions. In addition, placing the counterpart outer conductor and the cover plate portions in electrical communication via the mating body portion, front contact portions, and rear contact portions forms a return path through the counterpart outer conductor, arm-shaped portions, and cover plate portions, and thereby enhances shielding properties.

The first invention may be adapted such that the arm-shaped portions have base arm portions that extend rearwardly from the mating body portion, and, at a location inward of the base arm portions in the connector width direction perpendicular to both the direction of plugging and unplugging and the forward-backward direction, resilient arm portions that are coupled to the rear end portions of the base arm portions, extend forward, and are resiliently displaceable in the forward-backward direction, and the resilient arm portions, along with having the front contact portions in the front end portions of said resilient arm portions, have the rear contact portions at locations rearward of the front contact portions. With such an arrangement, the front contact portions can be contacted with the mating body portion under sufficient contact pressure.

The first invention may be adapted such that the cover plate portions have lateral plate portions with major faces that are perpendicular to the connector width direction and end plate portions that extend inwardly in the connector width direction from said lateral plate portions and have major faces perpendicular to the direction of plugging and unplugging, the resilient arm portions have sections that overlap with the end plate portions in the direction of plugging and unplugging as well as in the connector width direction, the rear contact portions are formed in said sections, and contact with the major faces of the end plate portions is made via said rear contact portions.

The coaxial electrical connector according to the second invention is a coaxial electrical connector to which the front end portion of a cable extending in a forward-backward direction is connected and which is plugged into and unplugged from a counterpart connector such that the direction of plugging and unplugging is the axial direction of the coaxial connector perpendicular to the forward-backward direction, said connector comprising an inner conductor having an internal contact portion that extends in the direction of plugging and unplugging and is enabled to contact a counterpart inner conductor provided in the counterpart connector, a dielectric body that secures the inner conductor in place, and an outer conductor that accommodates the dielectric body, with the outer conductor having a mating body portion that encloses the internal contact portion about an axis extending in the direction of plugging and unplugging and is enabled for mating contact with a counterpart outer conductor provided in the counterpart connector, and cover plate portions that cover a junction section between the inner conductor and the cable at a location rearward of said mating body portion.

Such a coaxial electrical connector, in the second invention, is characterized in that the outer conductor has contact pieces that extend from the cover plate portions, the contact pieces have front contact portions that are enabled to contact the mating body portion or the counterpart outer conductor, and bringing the front contact portions into contact with the mating body portion or the counterpart outer conductor places the counterpart outer conductor and the cover plate portions in electrical communication via the front contact portions.

In the second invention, the front contact portions formed in the contact pieces extending from the cover plate portions are adapted to contact the mating body portion or the counterpart outer conductor. In other words, since the contact pieces are located between the mating body portion or the counterpart outer conductor and the cover plate portions, the gap that was conventionally formed between the mating body portion or the counterpart outer conductor and the cover plate portions is covered by the contact pieces. In addition, bringing the front contact portions into contact with the mating body portion or the counterpart outer conductor forms a return path through the counterpart outer conductor, mating body portion, contact pieces and cover plate portions, or a return path through the counterpart outer conductor, contact pieces and cover plate portions, and thereby enhances shielding properties.

The second invention may be adapted such that the cover plate portions have lateral plate portions with major faces that are perpendicular to the connector width direction perpendicular to both the direction of plugging and unplugging and the forward-backward direction, and end plate portions that extend inwardly in the connector width direction from said lateral plate portions and have major faces perpendicular to the direction of plugging and unplugging, the end plate portions have formed therein slits that extend in the connector width direction at locations proximate to the front ends of said end plate portions and have resilient pieces that extend along said slits at locations forward of said slits and are resiliently displaceable in the forward-backward direction, and the contact pieces extend forwardly from the resilient pieces. With such an arrangement, the front contact portions of the contact pieces can contact the mating body portion or the counterpart outer conductor under sufficient contact pressure.

The second invention may be adapted such that the outer conductor has inner plate portions located within a range that includes at least a portion of the slits in the forward-backward direction as well as in the connector width direction, more proximately to the junction section than to the end plate portions in the direction of plugging and unplugging. Providing the inner plate portions at such a location can minimize the degradation of shielding properties due to the formation of the slits in the end plate portions.

The coaxial electrical connector according to the third invention is a coaxial electrical connector to which the front end portion of a cable extending in a forward-backward direction is connected and which is plugged into and unplugged from a counterpart connector such that the direction of plugging and unplugging is the axial direction of the coaxial connector perpendicular to the forward-backward direction, said connector comprising an inner conductor having an internal contact portion that extends in the direction of plugging and unplugging and is enabled to contact a counterpart inner conductor provided in the counterpart connector, a dielectric body that secures the inner conductor in place, and an outer conductor that accommodates the dielectric body, with the outer conductor having a mating body portion that encloses the internal contact portion about an axis extending in the direction of plugging and unplugging and is enabled for mating contact with a counterpart outer conductor provided in the counterpart connector, and cover plate portions that cover a junction section between the inner conductor and the cable at a location rearward of said mating body portion.

Such a coaxial electrical connector, in the third invention, is characterized in that the coaxial electrical connector has a metal intermediate member mounted to the cover plate portions, the intermediate member has front contact portions enabled to contact the mating body portion or the counterpart outer conductor and rear contact portions enabled to contact the cover plate portions, and bringing the front contact portions into contact with the mating body portion or the counterpart outer conductor while bringing the rear contact portions into contact with the cover plate portions places the counterpart outer conductor and the cover plate portions in electrical communication via the front contact portions and the rear contact portions.

In the third invention, the front contact portions of the intermediate member are adapted to contact the mating body portion or the counterpart outer conductor while the rear contact portions are adapted to contact the cover plate portions. In other words, since at least a portion of the intermediate member is located between the mating body portion or the counterpart outer conductor and the cover plate portions, the gap that was conventionally formed between the mating body portion or the counterpart outer conductor and the cover plate portions is covered by at least a portion of the intermediate member. In addition, bringing the front contact portions into contact with the mating body portion or the counterpart outer conductor while bringing the rear contact portions into contact with the cover plate portions forms a return path through the counterpart outer conductor, mating body portion, intermediate member and cover plate portions, or a return path through the counterpart outer conductor, intermediate member and cover plate portions, and thereby enhances shielding properties.

The third invention may be adapted such that the cover plate portions have lateral plate portions with major faces that are perpendicular to the connector width direction perpendicular to both the direction of plugging and unplugging and the forward-backward direction and end plate portions that extend inwardly in the connector width direction from said lateral plate portions and have major faces perpendicular to the direction of plugging and unplugging, the intermediate member has a main body portion that extends along the end plate portions and contact pieces that extend from the front end of said main body portion, the front contact portions are formed in the contact pieces, and the rear contact portions are formed in the main body portion.

The third invention may be adapted such that the contact pieces are resiliently displaceable in the forward-backward direction and the front contact portions are formed in the front end portions of the contact pieces. With such an arrangement, the front contact portions of the contact pieces can contact the mating body portion or the counterpart outer conductor under sufficient contact pressure.

The coaxial electrical connector according to the fourth invention is a coaxial electrical connector to which the front end portion of a cable extending in a forward-backward direction is connected and which is plugged into and unplugged from a counterpart connector such that the direction of plugging and unplugging is the axial direction of the coaxial connector perpendicular to the forward-backward direction, said connector comprising an inner conductor having an internal contact portion that extends in the direction of plugging and unplugging and is enabled to contact a counterpart inner conductor provided in the counterpart connector, a dielectric body that secures the inner conductor in place, and an outer conductor that accommodates the dielectric body, with the outer conductor having a mating body portion that encloses the internal contact portion about an axis extending in the direction of plugging and unplugging and is enabled for mating contact with a counterpart outer conductor provided in the counterpart connector, and cover plate portions that cover a junction section between the inner conductor and the cable at a location rearward of said mating body portion.

Such a coaxial electrical connector, in the fourth invention, is characterized in that the outer conductor has arm-shaped portions that extend from the mating body portion, the arm-shaped portions are of a curved shape and have front contact portions enabled to contact the counterpart outer conductor and rear contact portions enabled to contact the cover plate portions, and bringing the front contact portions into contact with the counterpart outer conductor while bringing the rear contact portions into contact with the cover plate portions places the counterpart outer conductor and the cover plate portions in electrical communication via the front contact portions and the rear contact portions.

In the fourth invention, the front contact portions of the arm-shaped portions are adapted to contact the counterpart outer conductor while the rear contact portions of said arm-shaped portions are adapted to contact the cover plate portions. In other words, since the arm-shaped portions are located between the mating body portion and the cover plate portions, the gap that was conventionally formed between the mating body portion and the cover plate portions is covered by the arm-shaped portions. In addition, placing the counterpart outer conductor and the cover plate portions in electrical communication via the front contact portions and the rear contact portions forms a return path through the counterpart outer conductor, arm-shaped portions, and cover plate portions, and thereby enhances shielding properties.

The fourth invention may be adapted such that the arm-shaped portions have base arm portions that extend rearwardly from the mating body portion, and, at a location inward of the base arm portions in the connector width direction perpendicular to both the direction of plugging and unplugging and the forward-backward direction, have resilient arm portions that are coupled to the rear end portions of the base arm portions, extend forward, and are resiliently displaceable in the direction of plugging and unplugging, the resilient arm portions, along with having the front contact portions in the front end portions of said resilient arm portions, have the rear contact portions at a location rearward of the front contact portions, and the front contact portions extend toward the counterpart connector in the direction of plugging and unplugging and are enabled to contact the counterpart outer conductor at a location outward of the mating body portion in a direction perpendicular to the direction of plugging and unplugging.

The fourth invention may be adapted such that the arm-shaped portions have base arm portions that extend rearwardly from the mating body portion, and, at a location inward of the base arm portions in the connector width direction perpendicular to both the direction of plugging and unplugging and the forward-backward direction, have resilient arm portions that are coupled to the rear end portions of the base arm portions, extend forward, and are resiliently displaceable in the forward-backward direction, the resilient arm portions, along with having the front contact portions in the front end portions of said resilient arm portions, have the rear contact portions at a location rearward of the front contact portions, and the front contact portions extend forward and are enabled to contact the counterpart mating body portion of the counterpart outer conductor that mates with the mating body portion.

The fourth invention may be adapted such that the cover plate portions have lateral plate portions with major faces that are perpendicular to the connector width direction and end plate portions that extend inwardly in the connector width direction from said lateral plate portions and have major faces perpendicular to the direction of plugging and unplugging, the resilient arm portions have sections that overlap with the end plate portions in the direction of plugging and unplugging as well as in the connector width direction, the rear contact portions are formed in said sections, and contact with the major faces of the end plate portions is made via said rear contact portions.

The second invention, the third invention, and the fourth invention, in which the front contact portions are enabled to contact the counterpart mating body portion, may be adapted such that the mating body portion has a gap in a portion of said mating body portion in the circumferential direction, and the front contact portions are located within the gap and are enabled to contact the counterpart outer conductor. Accordingly, forming the gap in the mating body portion and positioning the front contact portions within the gap prevents degradation of shielding properties within said gap.

The coaxial electrical connector according to the fifth invention is a coaxial electrical connector to which the front end portion of a cable extending in a forward-backward direction is connected and which is plugged into and unplugged from a counterpart connector such that the direction of plugging and unplugging is the axial direction of the coaxial connector perpendicular to the forward-backward direction, said connector comprising an inner conductor having an internal contact portion that extends in the direction of plugging and unplugging and is enabled to contact a counterpart inner conductor provided in the counterpart connector, a dielectric body that secures the inner conductor in place, and an outer conductor that accommodates the dielectric body, with the outer conductor having a mating body portion that encloses the internal contact portion about an axis extending in the direction of plugging and unplugging and is enabled for mating contact with a counterpart outer conductor provided in the counterpart connector, and cover plate portions that cover a junction section between the inner conductor and the cable at a location rearward of said mating body portion.

Such a coaxial electrical connector, in the fifth invention, is characterized in that the outer conductor has contact pieces that extend rearwardly from the mating body portion, the contact pieces have contact point portions that contact the cover plate portions, and bringing the contact point portions into contact with the cover plate portions places the counterpart outer conductor and the cover plate portions in electrical communication via the contact point portions.

In the fifth invention, the contact point portions of the contact pieces that extend rearwardly from the mating body portion are adapted to contact the cover plate portions. In other words, since the contact pieces are adapted to be located between the mating body portion and the cover plate portions, the gap that was conventionally formed between the mating body portion and the cover plate portions is covered by the contact pieces. In addition, placing the counterpart outer conductor and the cover plate portions in electrical communication via the contact pieces forms a return path through the counterpart outer conductor, mating body portion, contact pieces, and cover plate portions, and thereby enhances shielding properties.

The fifth invention may be adapted such that the cover plate portions have lateral plate portions with major faces that are perpendicular to the connector width direction perpendicular to both the direction of plugging and unplugging and the forward-backward direction and end plate portions that extend inwardly in the connector width direction from said lateral plate portions and have major faces perpendicular to the direction of plugging and unplugging, the contact pieces extend within the bounds of the end plate portions in the forward-backward direction, and the contact point portions are formed in the rear end portions of the contact pieces and are brought into contact with end plate portions in the direction of plugging and unplugging.

The fifth invention may be adapted such that the end plate portions have protrusions protruding toward the contact point portions in the direction of plugging and unplugging from the major faces of said end plate portions at locations corresponding to the contact point portions and are adapted to contact the contact point portions via said protrusions. Such an arrangement can ensure solid contact between the end plate portions and the contact pieces under contact pressure from the contact point portions.

The fifth invention may be adapted such that the outer conductor has engagement pieces that extend rearwardly from the mating body portion and reach the bounds of the end plate portions, and said engagement pieces, which are located more proximately to the junction section than to the end plate portions in the direction of plugging and unplugging, are positioned in a manner permitting engagement with the major faces of the end plate portions from said junction section. When the coaxial electrical connector is removed from the counterpart connector, the mating body portion of said coaxial electrical connector is subject to external forces acting in an opposite direction to the disengagement force as a result of friction, etc., against the counterpart connector. In the fifth invention, the engagement pieces that extend from the mating body portion are located in a manner permitting engagement with the major faces of the end plate portions in the direction of plugging and unplugging. Therefore, during connector removal, said engagement pieces engage the end plate portions, which makes it possible to counteract the external forces with the help of the engagement force to which said engagement pieces are subjected by the end plate portions (force acting in the same direction as the disengagement force) and this consequently allows for the coaxial electrical connector to be removed in a more reliable manner without damaging the connector.

The fifth invention may be adapted such that the engagement pieces are located outwardly of the contact pieces in the connector width direction. With such an arrangement, the engagement pieces are located proximate to the coupling section of the end plate portions and the lateral plate portions in the connector width direction. As a result, when the engagement pieces are engaged with the end plate portions during connector removal, the displacement of said end plate portions away from the junction section in the direction of plugging and unplugging can be avoided in the maximum degree.

Technical Effect

In the present invention, even if the mating body portion and the cover plate portions in the coaxial electrical connector are located in a spaced-apart relationship in the forward-backward direction, a portion of said outer conductor or a portion of the intermediate member mounted to said outer conductor is located between said mating body portion and the cover plate portions, and a return path along the signal transmission path is formed via the portion of said outer conductor or the portion of said intermediate member, which makes it possible to achieve enhanced shielding properties.

BRIEF DESCRIPTION OF DRAWINGS

FIGS. 4(A) and 4(B) illustrate views showing the electrical connector assembly of FIG. 1 in a mated state, wherein FIG. 4(A) is an oblique view, and 4(B) is a cross-sectional view showing a cross section taken in a plane perpendicular to the connector width direction.

FIGS. 6(A) and 6(B) illustrate cross-sectional views showing the components used in the process of manufacture of the receptacle coaxial electrical connector, wherein FIG. 6(A) shows the carrier-equipped receptacle inner conductor secured in place by the internal dielectric body, FIG. 6(B) shows the carrier-equipped receptacle outer conductor.

FIGS. 16(A) and 16(B) illustrate cross-sectional views showing a cross-section of the electrical connector assembly according to the fourth embodiment taken in a plane perpendicular to the connector width direction, wherein FIG. 16(A) shows a state immediately prior to connector mating, and FIG. 16(B) shows the connectors in a mated state.

FIG. 17(A) and FIG. 17(B) illustrate cross-sectional views showing a cross-section of an electrical connector assembly according to a variation of the fourth embodiment taken in a plane perpendicular to the connector width direction, wherein FIG. 17(A) shows a state immediately prior to connector mating, and FIG. 17(B) shows the connectors in a mated state.

DETAILED DESCRIPTION

Some embodiments of the present invention will be described hereinbelow by referring to the accompanying drawings.

First Embodiment

Figure 1:
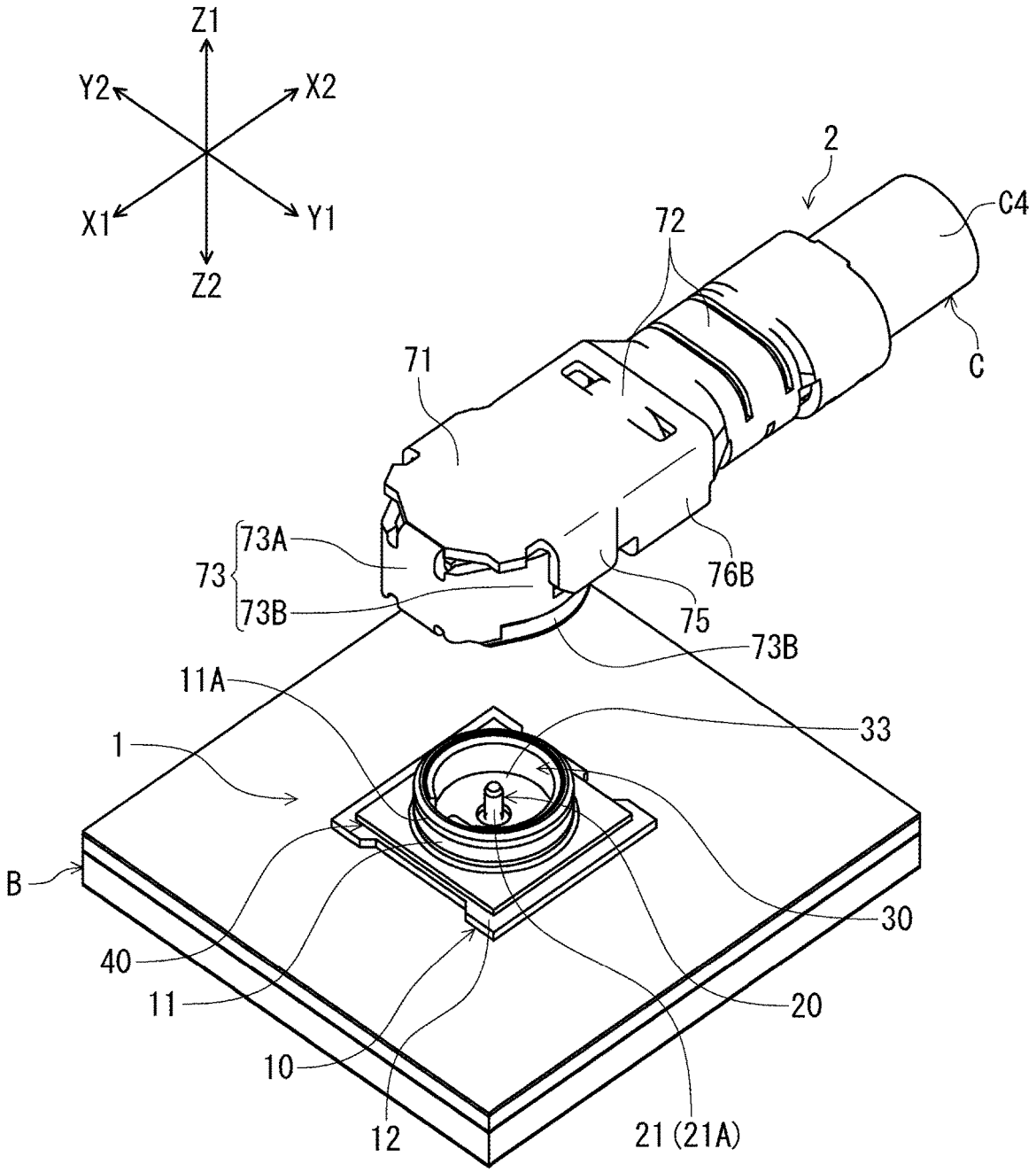
FIG. 1 illustrates an oblique view of an electrical connector assembly provided with the receptacle coaxial electrical connector and the plug coaxial electrical connector according to the first embodiment, shows a state immediately prior to connector mating.
Figure 2:
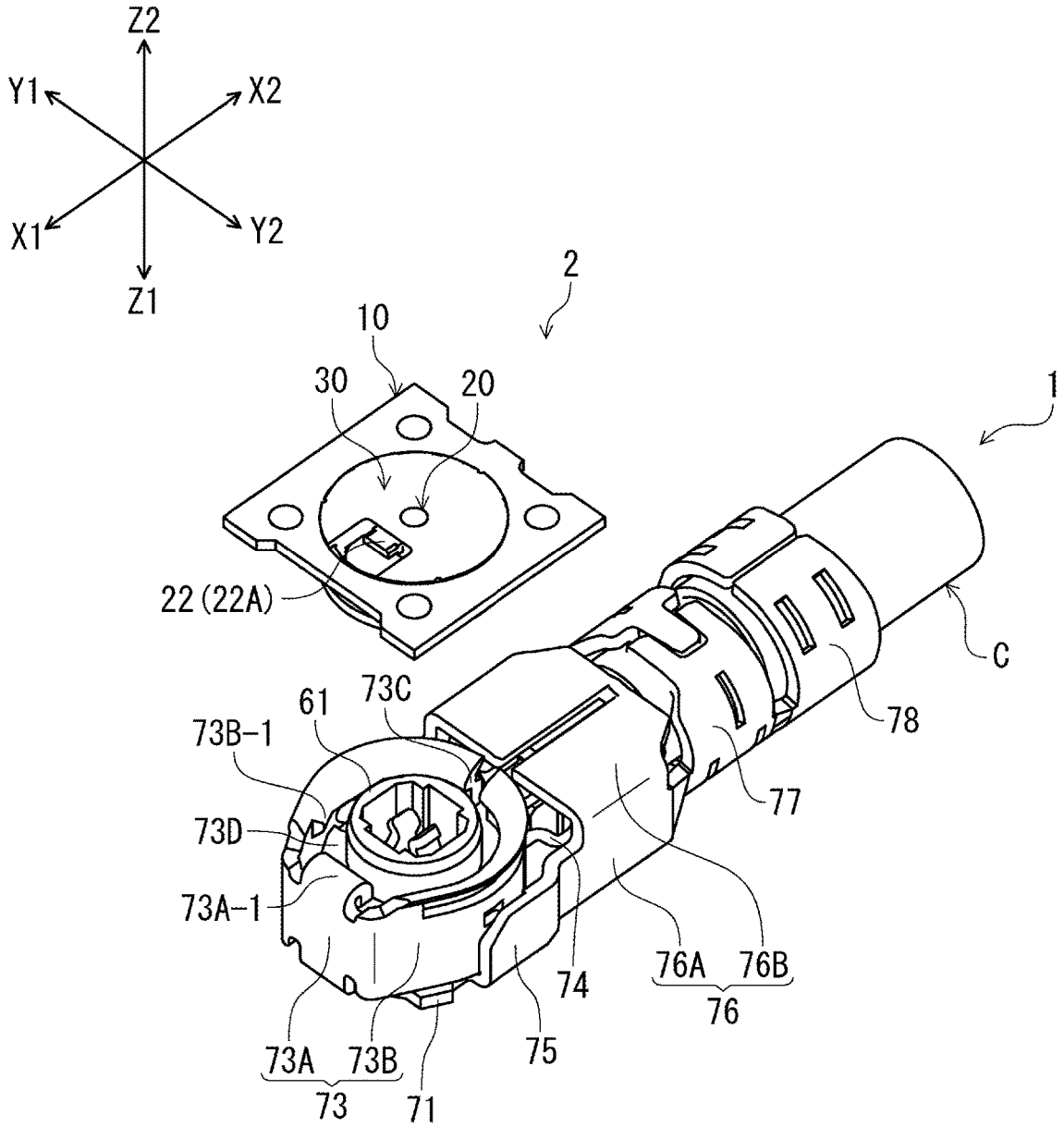
FIG. 2 illustrates an oblique view showing the electrical connector assembly of FIG. 1 in an inverted orientation.
Figure 3:
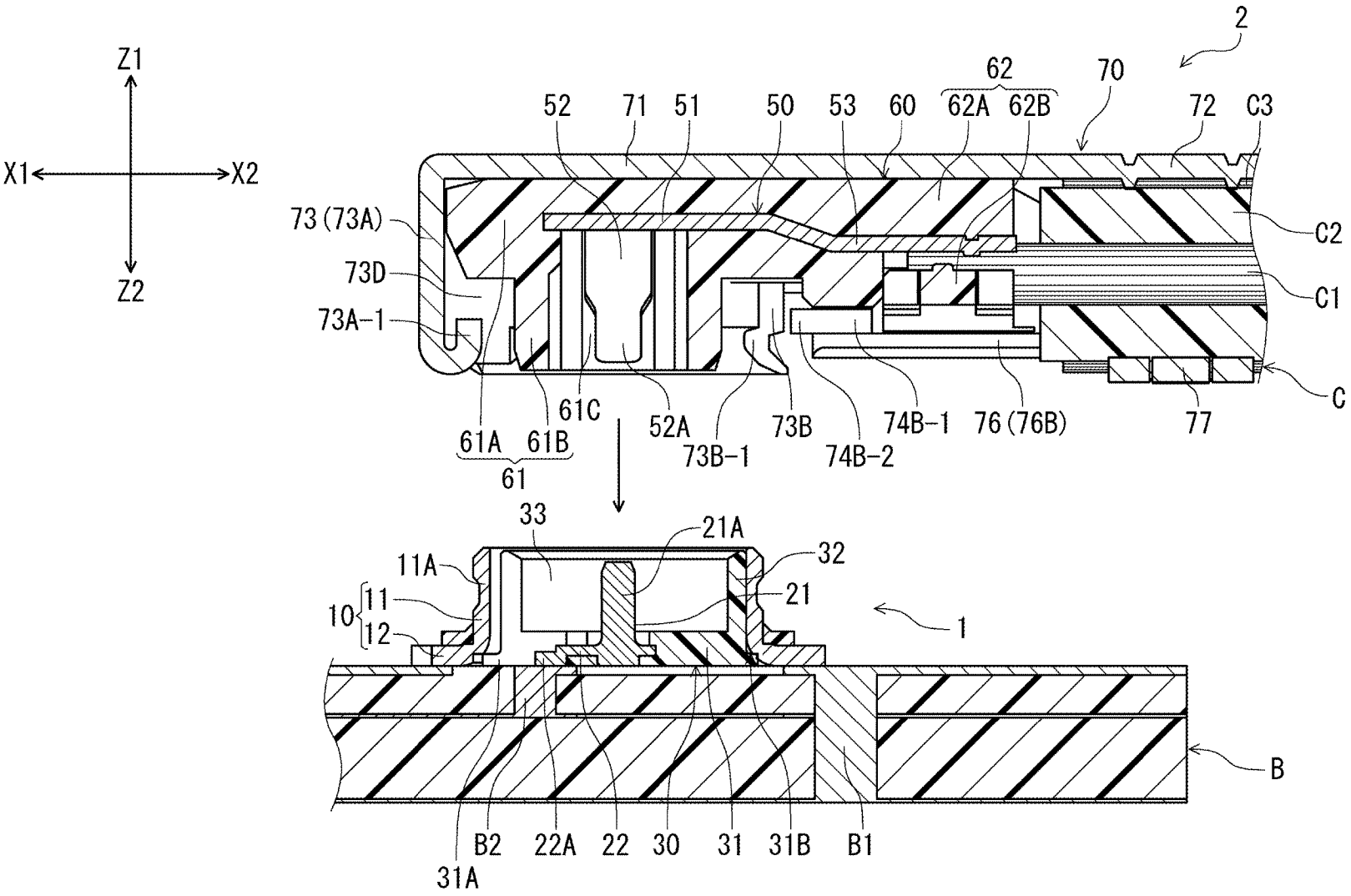
FIG. 3 illustrates a cross-sectional view showing a cross section taken in a plane perpendicular to the connector width direction of the electrical connector assembly of FIG. 1.
Figure 4A:
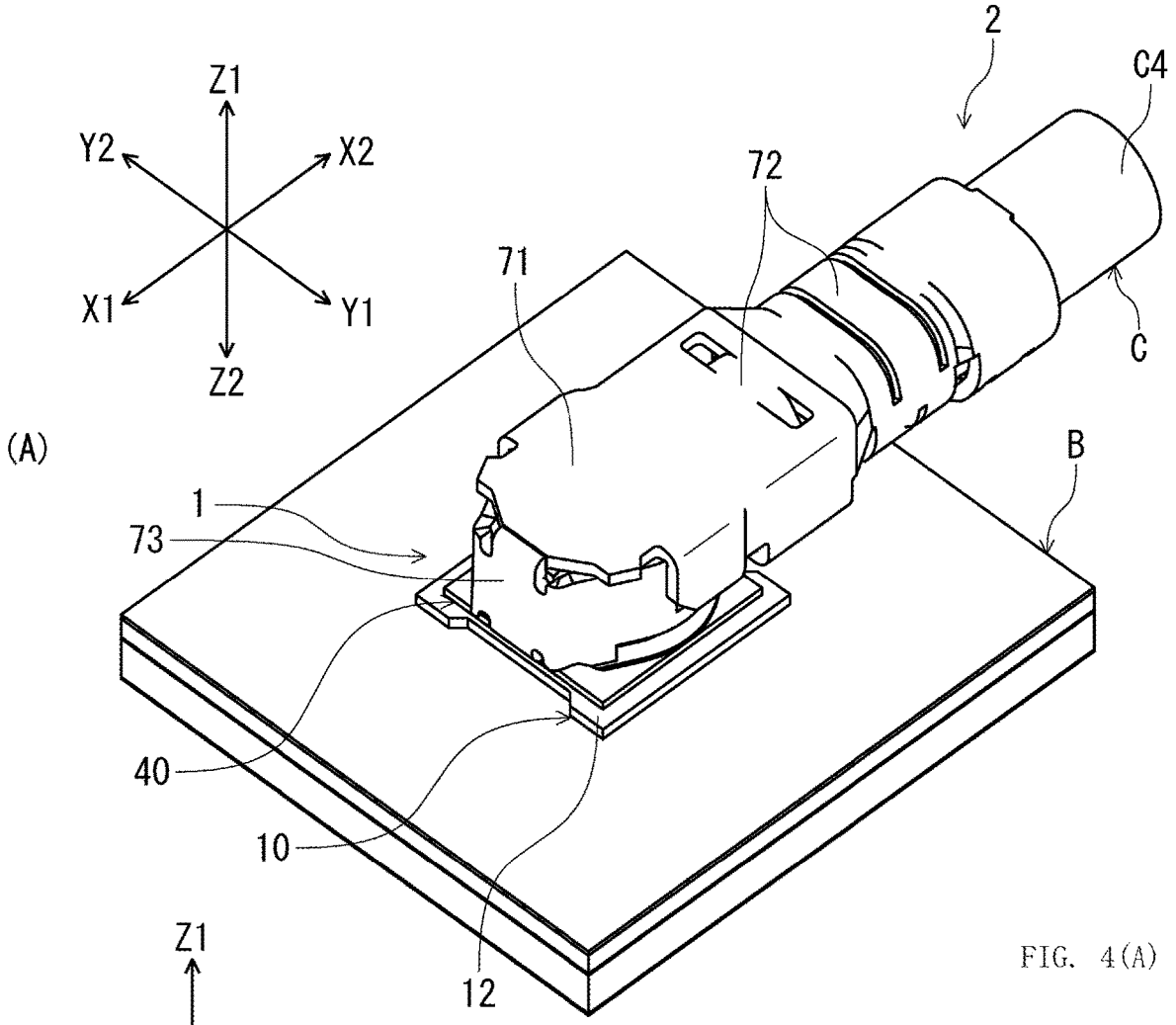
Figure 4B:
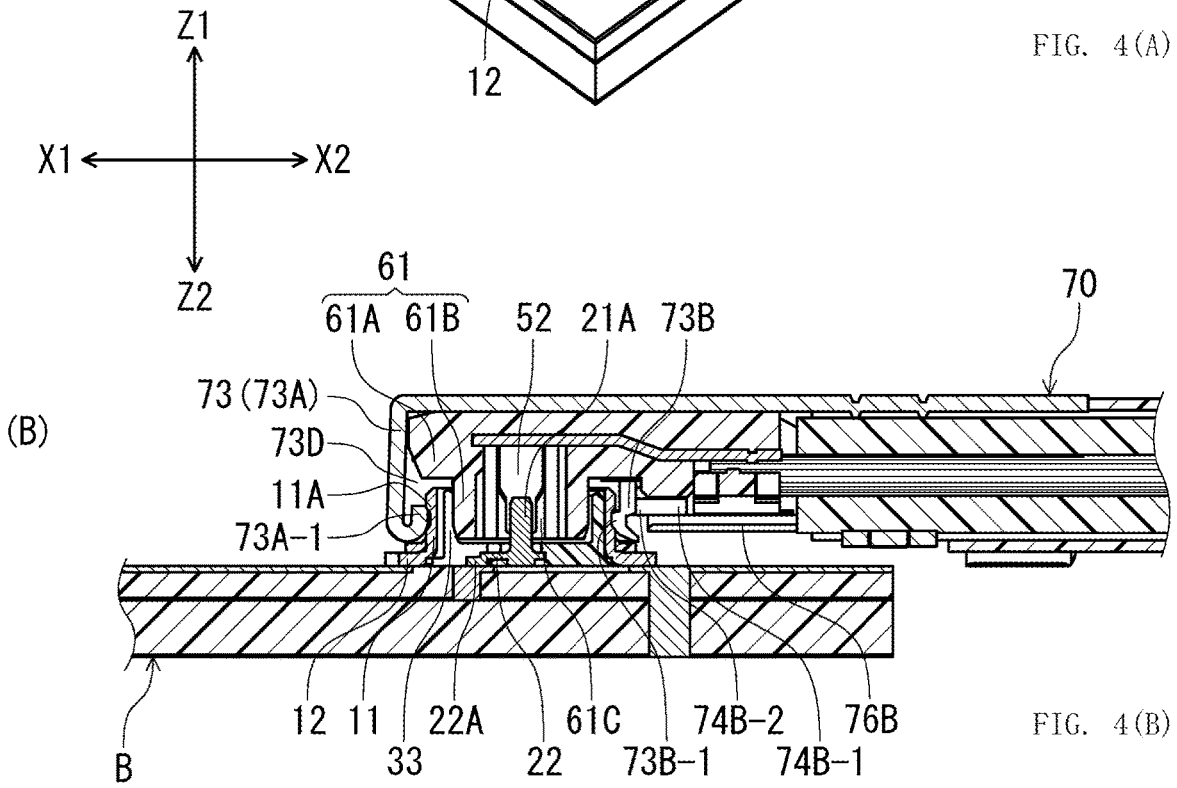

FIG. 1 is an oblique view of an electrical connector assembly provided with the receptacle coaxial electrical connector 1 (referred to as "receptacle connector 1" hereinbelow) and the plug coaxial electrical connector 2 (referred to as "plug connector 2") according to the present embodiment, and shows a state immediately prior to connector mating. FIG. 2 is an oblique view showing the electrical connector assembly of FIG. 1 in an inverted orientation. In FIG. 1, the receptacle connector 1 is shown mounted to the mounting face of a circuit board B, and in FIG. 2 circuit board B is not shown. In addition, FIG. 3 is a cross-sectional view showing a cross section taken in a plane perpendicular to the connector width direction of the electrical connector assembly of FIG. 1. FIG. 4(A) and FIG. 4(B) are views showing the electrical connector assembly of FIG. 1 in a mated state, wherein FIG. 4(A) is an oblique view, and FIG. 4(B) is a cross-sectional view showing a cross section taken in a plane perpendicular to the connector width direction.

As can be seen in FIG. 1, the receptacle connector 1 according to the present embodiment is a coaxial electrical connector which is mounted to the mounting face of circuit board B, and into and from which the plug connector 2 is plugged and unplugged such that the direction of plugging and unplugging is an up-down direction (Z-axis direction) perpendicular to said mounting face. Meanwhile, as can be seen in FIG. 1, the plug connector 2 according to the present embodiment is a coaxial electrical connector to which the front end portion (end portion on side X1 in FIG. 1) of a cable C extending in a forward-backward direction (X-axis direction), i.e., a direction parallel to the mounting face of circuit board B, is connected, and which is plugged into and unplugged from the receptacle connector 1 such that the direction of plugging and unplugging is an up-down direction. The counterpart connector for the receptacle connector 1 is the plug connector 2, and the counterpart connector for the plug connector 2 is the receptacle connector 1.

As can be seen in FIG. 1, the receptacle connector 1 includes a metal receptacle outer conductor 10 that has a tubular portion 11 whose axial direction is an up-down direction, a metal receptacle inner conductor 20 that is located in the interior space of said tubular portion 11, an internal dielectric body 30 that secures the receptacle outer conductor 10 and the receptacle inner conductor 20 in place, and an external dielectric body 40 that extends across the top face of the hereinafter-described ledge portion 12 of the receptacle outer conductor 10.

As can be seen in FIGS. 1 and 3, the receptacle outer conductor 10 is provided with the above-described tubular portion 11 and a ledge portion 12 that protrudes from the bottom end portion of said tubular portion 11 in the radial direction of said tubular portion 11. As can be seen in FIG. 3, the tubular portion 11 has a cylindrical configuration that extends in the up-down direction and is continuous in the circumferential direction of said tubular portion 11 throughout the entire circumference thereof. As can be seen in FIG. 3, the tubular portion 11 extends over a range that includes a hereinafter-described upright portion 21 of the receptacle inner conductor 20 in the up-down direction (see also FIG. 6(C)).

As can be seen in FIG. 4(B), the mating body portion 73 of the hereinafter-described plug outer conductor 70 of the plug connector 2 is adapted to be externally fitted onto the tubular portion 11 from above when the connectors are in a mated state. As can be seen in FIG. 1, FIG. 3, and FIG. 4(B), the tubular portion 11 has an external contact portion 11A that is enabled for contact with the mating body portion 73 of the plug outer conductor 70 at the top end side of said tubular portion 11. The external contact portion 11A has an annular configuration in which the exterior peripheral surface of said tubular portion 11 is recessed throughout the entire circumference of the tubular portion 11. To prevent inadvertent disengagement of the plug connector 2, the external contact portion 11A is enabled for locking by engaging the mating body portion 73 of the plug outer conductor 70 in the up-down direction with a stepped portion formed by recessing the exterior peripheral surface of the tubular portion 11 (see FIG. 4(B)).

Figure 5A:
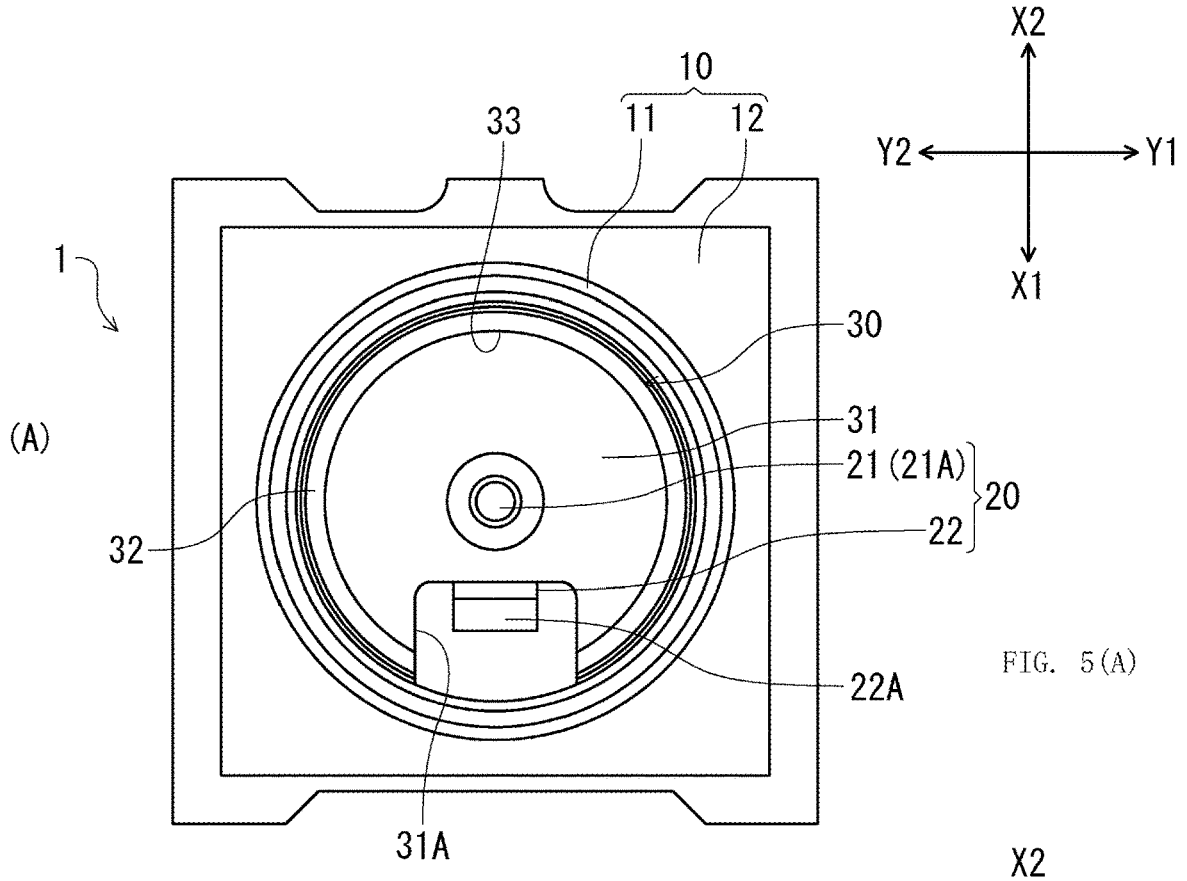
FIGS. 5(A) and 5(B) illustrate view showing the receptacle coaxial electrical connector of FIG. 1, wherein 5(A) is a plan view, and 5(B) is a bottom view.

As can be seen in FIG. 1, FIG. 3, and FIG. 4(B), the ledge portion 12 extends outwardly from a perimeter edge circumscribing the entire circumference of the bottom end portion of the tubular portion 11 in the radial direction of said tubular portion 11, in other words, across the mounting face of circuit board B, and has a substantially square geometry when viewed in the up-down direction (see FIG. 5(A)). As can be seen in FIG. 3, in the up-down direction, the ledge portion 12 is located within substantially the same range as the hereinafter-described projecting portion 22 of the receptacle inner conductor 20 and, accordingly, the connecting portion 22A (see also FIG. 6(C)). In addition, the bottom face of the ledge portion 12 is level with the bottom face of the connecting portion 22A. As can be seen in FIG. 3 and FIG. 4(B), the ledge portion 12 has its bottom face solder-connected to the ground circuits B1 on the mounting face of circuit board B, thereby placing the receptacle outer conductor 10 in electrical communication with the ground circuits B1.

Figure 5B:
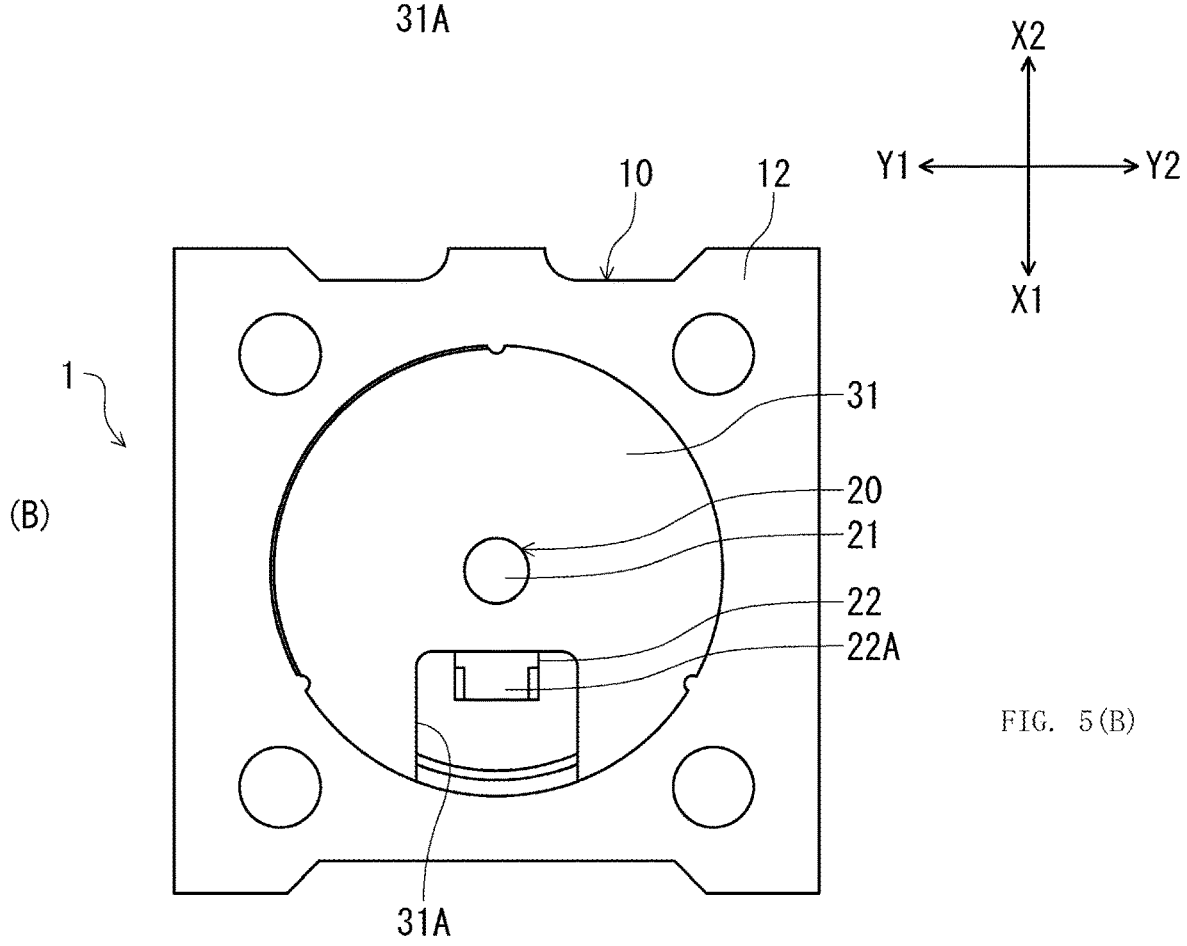

FIG. 5(A) is a plan view of the receptacle connector 1 and FIG. 5(B) is a bottom view of the receptacle connector 1. As can be seen in FIG. 3 and FIG. 5(A) and FIG. 5(B), the receptacle inner conductor 20 has a pin-shaped upright portion 21 that extends in the up-down direction at the center location in the radial direction of the tubular portion 11 of the receptacle outer conductor 10, and a strip-shaped projecting portion 22 that extends outwardly from the bottom end section of said upright portion 21 in the radial direction of the tubular portion 11, in other words, across the mounting face of circuit board B. The upright portion 21 has formed therein a section that extends higher than the bottom plate portion 31 of the hereinafter-described internal dielectric body 30 as an internal contact portion 21A in the interior space of the tubular portion 11, and is enabled for contact with the hereinafter-described plug inner conductor 50 of the plug connector 2 through the medium of said internal contact portion 21A (see FIG. 4(B)).

In the present embodiment, the entire receptacle inner conductor 20 is surrounded by the receptacle outer conductor 10 in the circumferential direction of said tubular portion 11 throughout the entire circumference thereof. As can be seen in FIG. 3, FIG. 4(B), and FIGS. 5(A) and 5(B), the projecting portion 22 is shorter than the radius of the interior space of the tubular portion 11 in the radial direction and, furthermore, than the radius of the hereinafter-described receiving portion 33 of the internal dielectric body 30. In other words, the outer edge of the projecting portion 22, that is, the outer edge of the hereinafter-described connecting portion 22A, is located in the interior of the tubular portion 11 in the radial direction, and also in the interior of the receiving portion 33 of the internal dielectric body 30.

As can be seen in FIG. 3, the distal end section (outer edge section) of the projecting portion 22 in the radial direction is formed as a connecting portion 22A, which is located below the proximal end section coupled to the upright portion 21 and is connected to the signal circuits B2 of circuit board B. In the up-down direction, the bottom face of the connecting portion 22A is substantially level with the signal circuits B2 of the mounting face. The connecting portion 22A is solder-connected to the signal circuits B2 on the mounting face while placed in surface contact therewith, thereby bringing the receptacle inner conductor 20 in electrical communication with the signal circuits B2.

As can be seen in FIG. 3 and FIG. 4(B), the internal dielectric body 30 has a substantially disk-like bottom plate portion 31 that extends across the mounting face of circuit board B, and an upwardly open standing portion 32 that rises upward from the bottom plate portion 31 along the inner peripheral surface of the tubular portion 11 of the receptacle outer conductor 10. As can be seen in FIG. 3, in the bottom plate portion 31, the bottom face of the bottom plate portion 31 is located substantially level with the mounting face of circuit board B. In the up-down direction, the bottom plate portion 31 is formed to a thickness in a range that includes the projecting portion 22 and the bottom end portion of the upright portion 21 of the receptacle inner conductor 20, and secures the projecting portion 22 and the bottom end portion of the upright portion 21 in place via unitary co-molding.

A notch-like passage portion 31A, which is open outwardly in the radial direction and that extends in the up-down direction, is formed in the bottom plate portion 31. Therefore, when viewed in the up-down direction, the bottom plate portion 31 has an exterior configuration in which a section in the circular circumferential direction has been cut out (see FIGS. 5(A) and 5(B)). As can be seen in FIGS. 5(A) and 5(B), the passage portion 31A includes the projecting portion 22 in the circumferential direction of the tubular portion 11 and, in addition, is formed in a range extending from an intermediate location of the bottom plate portion 31 in the radial direction to the location of the outer edge (see also FIG. 3). As can be seen in FIG. 3, the outer edge portion 31B of the bottom plate portion 31 in the radial direction protrudes outward of the standing portion 32 in the radial direction and is located within the thickness of the tubular portion 11 of the receptacle outer conductor 10 directly below the tubular portion 11. In other words, the opening portion of the passage portion 31A in the radial direction is located within the thickness of the tubular portion 11 directly below the tubular portion 11. Therefore, as illustrated in FIG. 5(A), when the receptacle connector 1 is viewed from above, the passage portion 31A forms an aperture (window portion), whose opening portion is sealed by the inner peripheral surface of the tubular portion 11.

The standing portion 32 has an upwardly open cylindrical configuration. The standing portion 32, whose outer diameter is slightly larger than the inner diameter of the tubular portion 11 of the receptacle outer conductor 10, is adapted to be mounted into the tubular portion 11 by press-fitting from below. As a result of press-fitting the standing portion 32 in this manner, the internal dielectric body 30 secures the receptacle outer conductor 10 in place. The interior space of the internal dielectric body 30, that is, the space enclosed by the standing portion 32, is formed as a receiving portion 33 used for receiving the hereinafter-described small diameter portion 61B of the plug connector 2 (see FIG. 4(B)).

As shown in FIG. 1, the external dielectric body 40 extends across the top face of the ledge portion 12 of the receptacle outer conductor 10 and has a thin plate-like configuration of a substantially square geometry slightly smaller than the ledge portion 12 of the receptacle outer conductor 10 when viewed from above. The external dielectric body 40 serves to prevent inadvertent solder wicking, i.e., the spread of molten solder over a large area on the top face of the ledge portion 12 when the ledge portion 12 is solder-connected to the ground circuits B1 of circuit board B.

The receptacle connector 1 of the above configuration is fabricated in accordance with the following procedure. FIG. 6 shows cross-sectional views showing the components used in the process of manufacture of the receptacle connector 1, wherein (A) shows the carrier-equipped receptacle inner conductor secured in place by the internal dielectric body, (B) shows the carrier-equipped receptacle outer conductor, and (C) shows the receptacle inner conductor of (A) press-fitted into the carrier-equipped receptacle outer conductor of (B) using cross-sections taken in a plane perpendicular to the connector width direction.

Figure 6A:
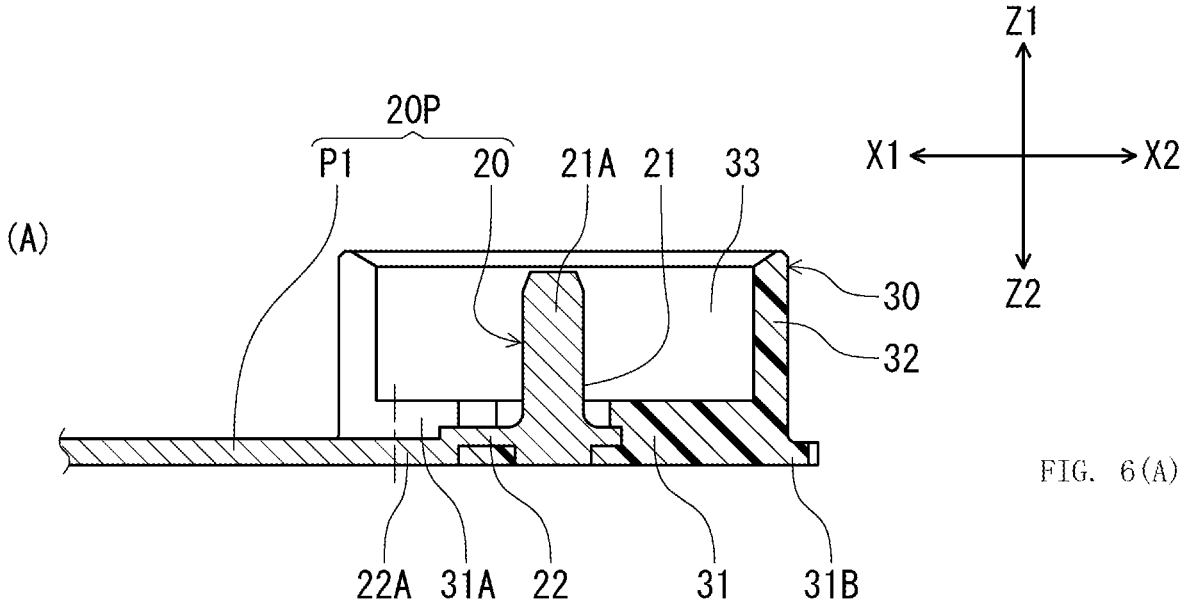

First, a carrier-equipped inner conductor 20P, in which a strip-shaped carrier P1 extends straight outwardly in the radial direction from the outer edge (distal end) of the projecting portion 22 of the receptacle inner conductor 20 (see FIG. 6(A)), is provided, and the carrier-equipped inner conductor 20P is secured in place by clamping in a mold (not shown) in the up-down direction in a section that includes the boundary between the carrier P1 and the outer edge of the projecting portion 22, in other words, the outer edge of the connecting portion 22A (the location indicated by the one-dot chain line in FIG. 6(A)).

Next, molten dielectric material (resin material) is injected into the cavity of the mold and allowed to solidify, thereby molding the internal dielectric body 30 (see FIG. 6(A)). As a result, the projecting portion 22 and the bottom end portion of the upright portion 21 of the receptacle inner conductor 20 are secured in place via unitary co-molding with the bottom plate portion 31 of the internal dielectric body 30. Subsequently, a notch-like passage portion 31A, which is open outwardly in the radial direction and that extends in the up-down direction, is formed in the bottom plate portion 31 by extracting the mold. At such time, the section that was held in the mold, i.e., the section that includes the boundary, is located within the passage portion 31A and is not covered by the internal dielectric body 30 while not being held in place by the bottom plate portion 31. Next, the carrier P1 is cut from the connecting portion 22A at the boundary with a jig used for carrier removal (not shown). As a result, the outer edge section of the connecting portion 22A is positioned so as to protrude into the passage portion 31A (see also FIGS. 5(A) and 5(B)).

Figure 6B:
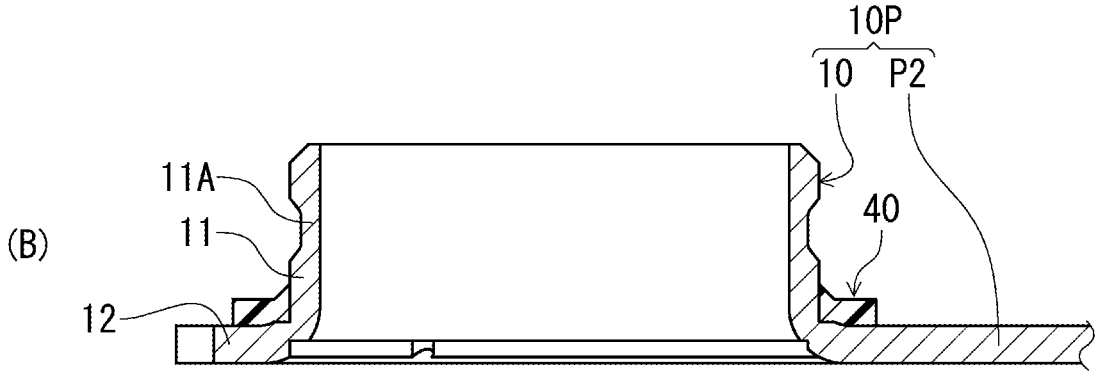

In addition, a carrier-equipped outer conductor 10P (see FIG. 6(B)), in which a carrier P2 extends from a portion of the perimeter edge of the ledge portion 12 of the receptacle outer conductor 10 in parallel to the major faces of the ledge portion 12 (faces perpendicular to the through-thickness faces), is provided, and the exterior peripheral edge portion of the ledge portion 12 is secured in place by clamping in the up-down direction in a mold (not shown). Next, molten dielectric material (resin material) is injected into the cavity of the mold to form the external dielectric body 40 extending across the top face of the ledge portion 12 (see FIG. 6(B)).

Figure 6C:
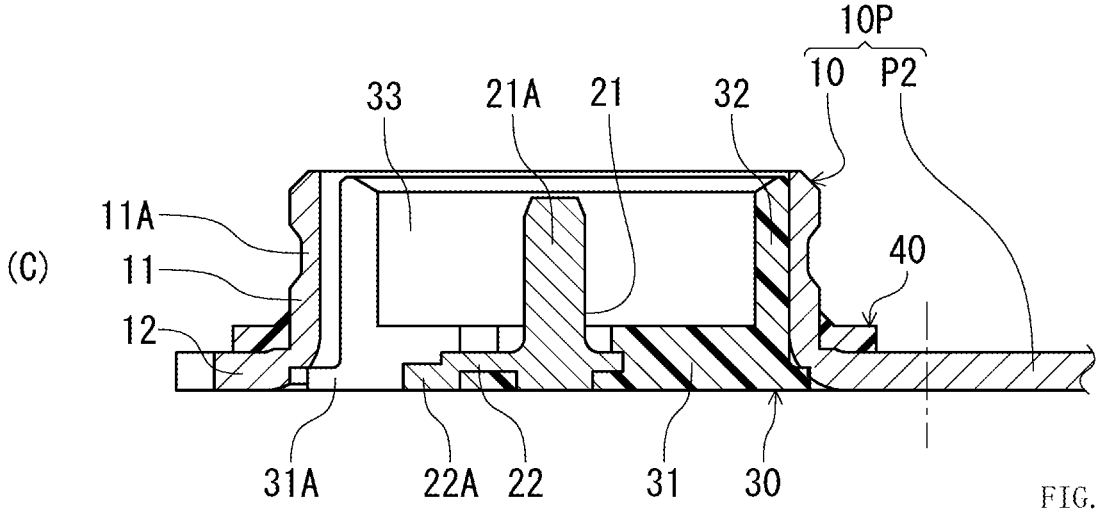
FIG. 6(C) shows the inner conductor of FIG. 6(A) press-fitted into the carrier-equipped receptacle outer conductor of FIG. 6(B), using cross-sections taken in a plane perpendicular to the connector width direction.

Next, as can be seen in FIG. 6(C), the standing portion 32 of the internal dielectric body 30 is mounted into the tubular portion 11 of the carrier-equipped outer conductor 10P from below by press-fitting. A jig used for carrier removal (not shown) is then used to cut the carrier P2 from the ledge portion 12 at the boundary between the perimeter edge of the ledge portion 12 and the carrier P2 (at the location indicated by the one-dot chain line in FIG. 6(C)). This completes the fabrication of the receptacle connector 1.

The receptacle connector 1 fabricated in accordance with the above procedure ensures adequate shielding properties because the receptacle outer conductor 10 surrounds the entire receptacle inner conductor 20 in the circumferential direction of the tubular portion 11 throughout the entire circumference thereof. In addition, the receptacle outer conductor 10 includes the entire internal contact portion 21A and the entire projecting portion 22 in the up-down direction, and the bottom end of the receptacle outer conductor 10 is located substantially level with the bottom face of the connecting portion 22A. In other words, when the receptacle connector 1 is disposed on the mounting face of circuit board B, the bottom end of the receptacle outer conductor 10 is in close proximity to the mounting face with little clearance therefrom, thereby further improving shielding properties. Here, it is not essential for the receptacle outer conductor 10 to include the entire projecting portion 22 in the up-down direction, and, as long as adequate shielding properties can be ensured, the receptacle outer conductor 10 may be located so as to include a portion of the projecting portion 22 in the up-down direction. In addition, the receptacle connector 1 can be manufactured in a simple and easy manner because in the present embodiment, in the first place, the tubular portion 11 of the receptacle outer conductor 10 does not have a conventional notched portion in a portion thereof in the circumferential direction, and there is no need to additionally provide a metal sheet member to seal said notched portion.

Although in the receptacle connector 1 of the present embodiment the standing portion 32 of the internal dielectric body 30 is mounted to the tubular portion 11 of the receptacle outer conductor 10 by press-fitting during the manufacturing process, the mounting process is not limited thereto. For example, mounting can be performed by providing an internal dielectric body having a standing portion with an outer diameter that is slightly smaller than the inner diameter of the tubular portion of the receptacle outer conductor, inserting said standing portion into the tubular portion from below, and crimping the tubular portion in a radial direction while maintaining this state. Based on such a mounting process, the receptacle outer conductor can also be readily attached to the dielectric body.

The configuration of the plug connector 2 will be described next. As discussed above, the plug connector 2 is a coaxial electrical connector having connected thereto the front end portion of the cable C that extends in the forward-backward direction. As can be seen in FIG. 3, the cable C is a coaxial cable in which a metal core wire C1 is disposed within a cable dielectric body C2 made of dielectric material, a shield wire C3 is provided around the periphery of said cable dielectric body C2, and, furthermore, a jacket C4 (see FIG. 1) made of dielectric material is provided around the outer periphery thereof. The shield wire C3 is exposed in the front end portion of the cable C and the core wire C1 is exposed forwardly of the shield wire C3. This exposed core wire C1 is connected to the hereinafter-described plug inner conductor 50 of the plug connector 2. In addition, as described hereinafter, in the front end portion of the cable C, the jacket C4 and the exposed shield wire C3 are tightly clamped and secured in place by the plug outer conductor 70 (see also FIG. 7).

The plug connector 2 includes a metal plug inner conductor 50 that is enabled for contact with the receptacle inner conductor 20 of the receptacle connector 1, a dielectric body 60 made of resin that secures said plug inner conductor 50 in place by unitary co-molding, and a metal plug outer conductor 70 that accommodates said dielectric body 60.

Figure 8B:
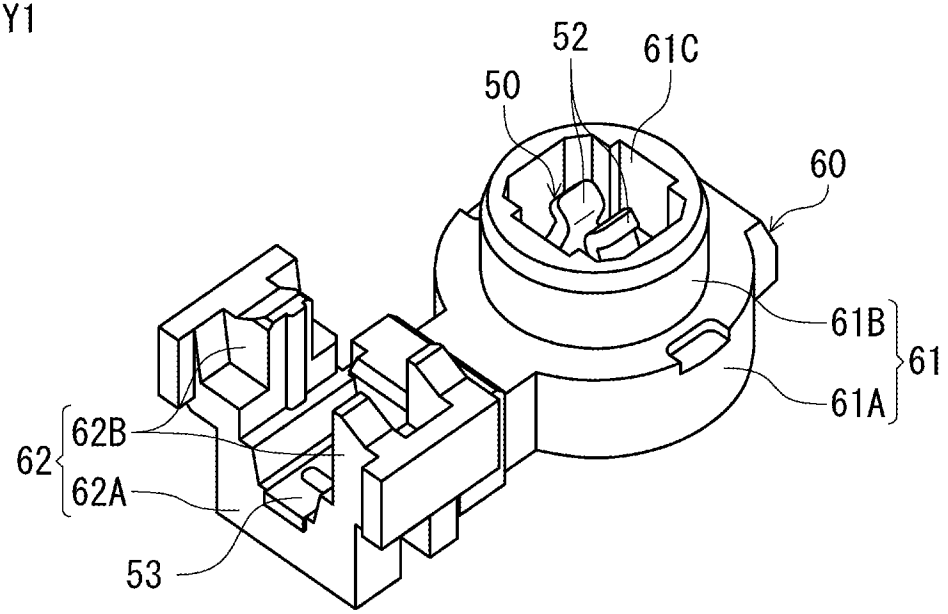
FIG. 8(B) is an oblique view showing the plug inner conductor of FIG. 8(A) secured in place by the internal dielectric body.
Figure 8A:
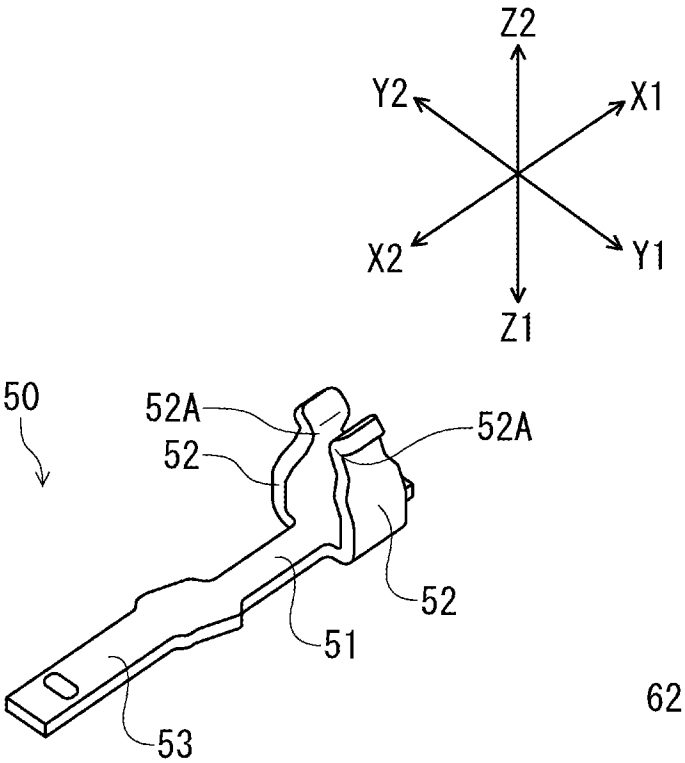
FIG. 8(A) is an oblique view showing a plug inner conductor in isolation.

FIG. 8(A) is an oblique view showing the plug inner conductor 50 in isolation, and FIG. 8(B) is an oblique view showing the plug inner conductor 50 secured in place by the dielectric body 60. The plug inner conductor 50 is made by bending a metal sheet member and, as can be seen in FIG. 8(A), has a strip-shaped strip portion 51 that extends in the forward-backward direction and whose through-thickness direction is an up-down direction, a pair of internal contact portions 52 that extend upwardly (Z2 direction) from the opposite lateral edges of the front end portion of the strip portion 51, and an interconnect portion 53 that extends rearwardly (X2 direction) from the rear end of the strip portion 51 and to which the core wire C1 of the cable C is connected.

As can be seen in FIG. 8(A), the pair of internal contact portions 52 have their major faces arranged in a face-to-face relationship in the connector width direction (Y-axis direction) and are enabled for resilient displacement in the connector width direction. The pair of internal contact portions 52 have contact protrusions 52A protruding so as to approach each other on the top end side in FIG. 8(A). When the connectors are mated, the internal contact portion 21A of the receptacle inner conductor 20 is clamped by the pair of contact protrusions 52A and brought into contact with said contact protrusions 52A. The interconnect portion 53 is secured in place by the hereinafter-described base portion 62A of the dielectric body 60 (see FIG. 8(B)). As can be seen in FIG. 3, the front half of the interconnect portion 53 (section on side X1) is secured in place by embedding into the base portion 62A such that its entire peripheral surface is covered, while the rear half of the interconnect portion 53 (section on side X2) is secured in place by the base portion 62A while exposing the major face constituting its bottom face (top face in FIG. 8(B)). The core wire C1 of the cable C is connected to the exposed major face of this interconnect portion 53 by crimping (see FIG. 3). The core wire C1 may be connected to the interconnect portion 53 using solder connections.

As can be seen in FIG. 8(B), the dielectric body 60 has a bottomed cylinder-shaped stepped tubular portion 61 whose axis extends in the up-down direction, and an interconnect retaining portion 62 coupled to the rear end of the hereinafter-described large diameter portion 61A of said stepped tubular portion 61. As can be seen in FIG. 8(B), the stepped tubular portion 61 has a large diameter portion 61A, which constitutes the bottom half, and a small diameter portion 61B, which constitutes the top half and whose diameter is smaller than that of the large diameter portion 61A, and the boundary section between the large diameter portion 61A and the small diameter portion 61B is formed in a stepped configuration. Along with securing the strip portion 51 of the plug inner conductor 50 in place in its bottom portion, the stepped tubular portion 61 holds the pair of internal contact portions 52 of the plug inner conductor 50 in an inner receiving portion 61C constituting the interior space of said stepped tubular portion 61 in a manner permitting resilient displacement (see also FIG. 3). As can be seen in FIG. 8(B), the inner receiving portion 61C is upwardly (Z2 direction) open and receives the internal contact portion 21A of the receptacle connector 1 in said inner receiving portion 61C, thereby enabling contact between said internal contact portion 21A and the internal contact portions 52 (see FIG. 4(B)).

The interconnect retaining portion 62 has a base portion 62A that extends rearwardly (X2 direction) from the rear end of the large diameter portion 61A, and pressure contact portions 62B that are coupled to the top portions of the respective opposite lateral edges of said base portion 62A. The base portion 62A secures the interconnect portion 53 of the plug inner conductor 50 in place. The pressure contact portions 62B are enabled for displacement so as to inwardly collapse in the connector width direction about the locations of coupling to the base portion 62A as fulcrums, and, as described hereinafter, are adapted to secure the junction section between the interconnect portion 53 of the plug inner conductor 50 and the core wire C1 of the cable C in place by applying pressure from above in FIG. 8(B) (see also FIG. 3).

The plug outer conductor 70 is fabricated by bending a metal sheet member. As can be seen in FIGS. 1 to 3, the plug outer conductor 70 has a cover portion 71 that extends across the bottom face (top face in FIG. 1) of the stepped tubular portion 61 of the dielectric body 60, a backplate portion 72 that extends rearwardly (X2 direction) from the cover portion 71, a mating body portion 73 that surrounds the stepped tubular portion 61 of the dielectric body 60 about an axis extending in the up-down direction, arm-shaped portions 74 that are coupled to the rear end of the mating body portion 73, front lateral plate portions 75 that extend downwardly in FIG. 1 (Z2 direction) from the opposite lateral edges of the cover portion 71 opposed in the connector width direction, as well as cover plate portions 76, shield retaining portions 77, and cable retaining portions 78 that extend from the opposite lateral edges of the front end portion of the backplate portion 72 opposed in the connector width direction.

As can be seen in FIG. 3, the cover portion 71, which has a planar configuration with major faces perpendicular to the up-down direction (faces perpendicular to the through-thickness faces), covers the bottom face of the stepped tubular portion 61 of the dielectric body 60 (top face in FIG. 3) from above. The backplate portion 72 extends in the forward-backward direction within a range that includes the front end portion of the cable C (see FIG. 3). As can be seen in FIG. 2, which shows the plug connector 2 of FIG. 1 in a vertically inverted configuration, the mating body portion 73 has a front plate portion 73A that is bent at the front end edge of the cover portion 71 and extends upwardly in FIG. 2 (in the Z2 direction), and curved plate portions 73B (see also FIG. 7) that extend rearwardly from the respective ends of said front plate portion 73A opposed in the connector width direction (Y-axis direction) while curving along the stepped tubular portion 61 of the dielectric body 60. As can be seen in FIG. 2, the front plate portion 73A has a first external contact portion 73A-1 that extends upwardly from the top end edge of said front plate portion 73A and is then folded back downward on the rear side (see also FIG. 3). When the connectors are mated, this first external contact portion 73A-1 is enabled for contact with the external contact portion 11A of the receptacle connector 1 and is enabled for locking by engaging with the external contact portion 11A in the up-down direction (see FIG. 4(B)).

On the top end side of the curved plate portions 73B in FIG. 2, the pair of curved plate portions 73B have second external contact portions 73B-1 that protrude in the radial inward direction of the mating body portion 73 while extending in the circumferential direction of the mating body portion 73. The second external contact portions 73B-1 are enabled for contact with the external contact portion 11A of the receptacle outer conductor 10 in the radial direction and are enabled for locking by engaging with the external contact portion 11A in the up-down direction (see FIG. 4(B)). In addition, as can be seen in FIG. 2 and FIG. 7, a gap 73C is formed between the rear ends of the pair of curved plate portions 73B.

Figure 7:
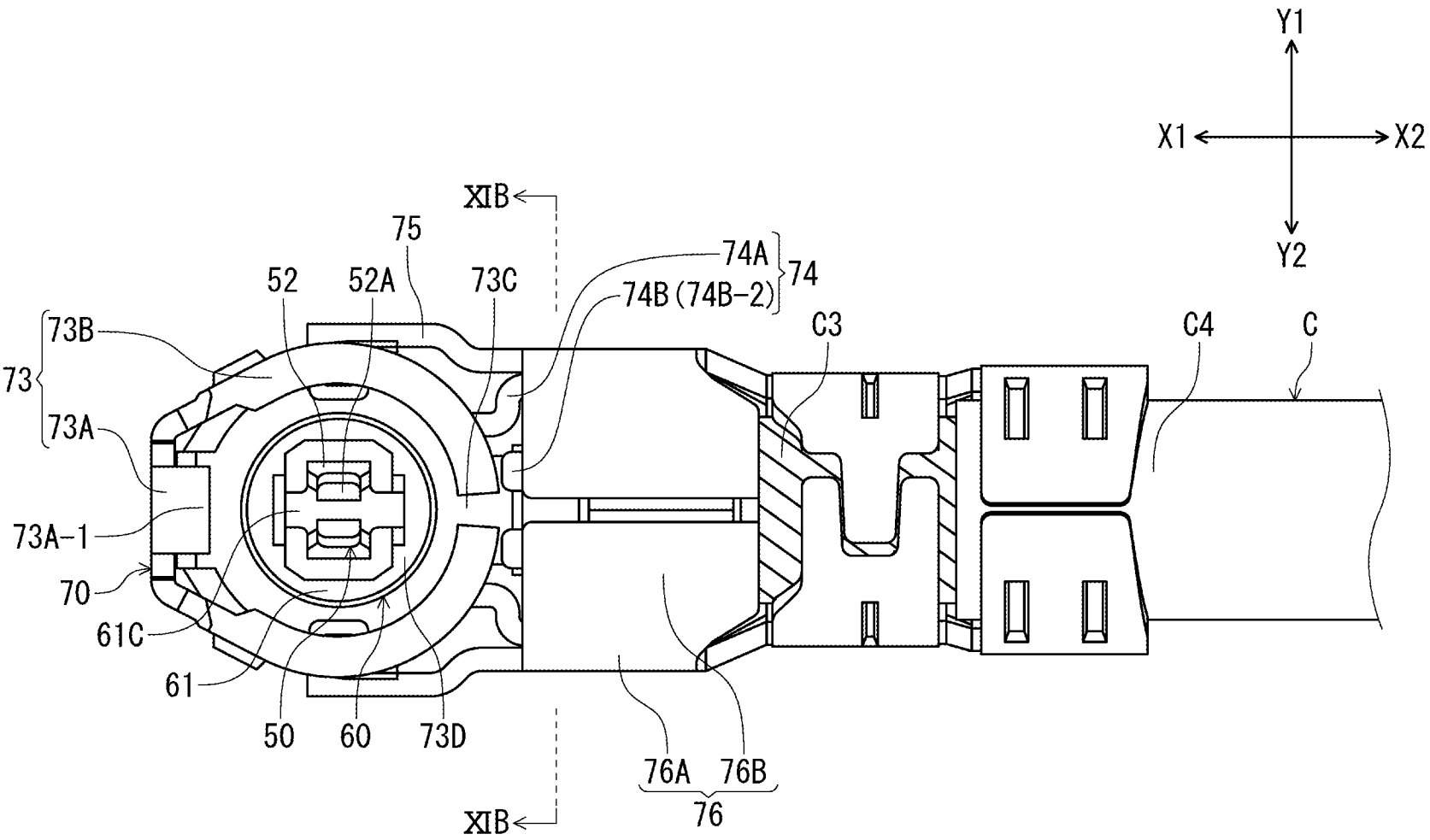
FIG. 7 illustrates a bottom view of the plug coaxial electrical connector of FIG. 1.

As can be seen in FIG. 2 and FIG. 7, the stepped tubular portion 61 of the dielectric body 60 is held within the space enclosed by the front plate portion 73A and the pair of curved plate portions 73B. The substantially annular space formed between this front plate portion 73A and the pair of curved plate portions 73B, on the one hand, and the stepped tubular portion 61, on the other hand, constitutes an external receiving portion 73D capable of receiving the tubular portion 11 of the receptacle outer conductor 10 (see also FIG. 4(B)).

Figure 9:
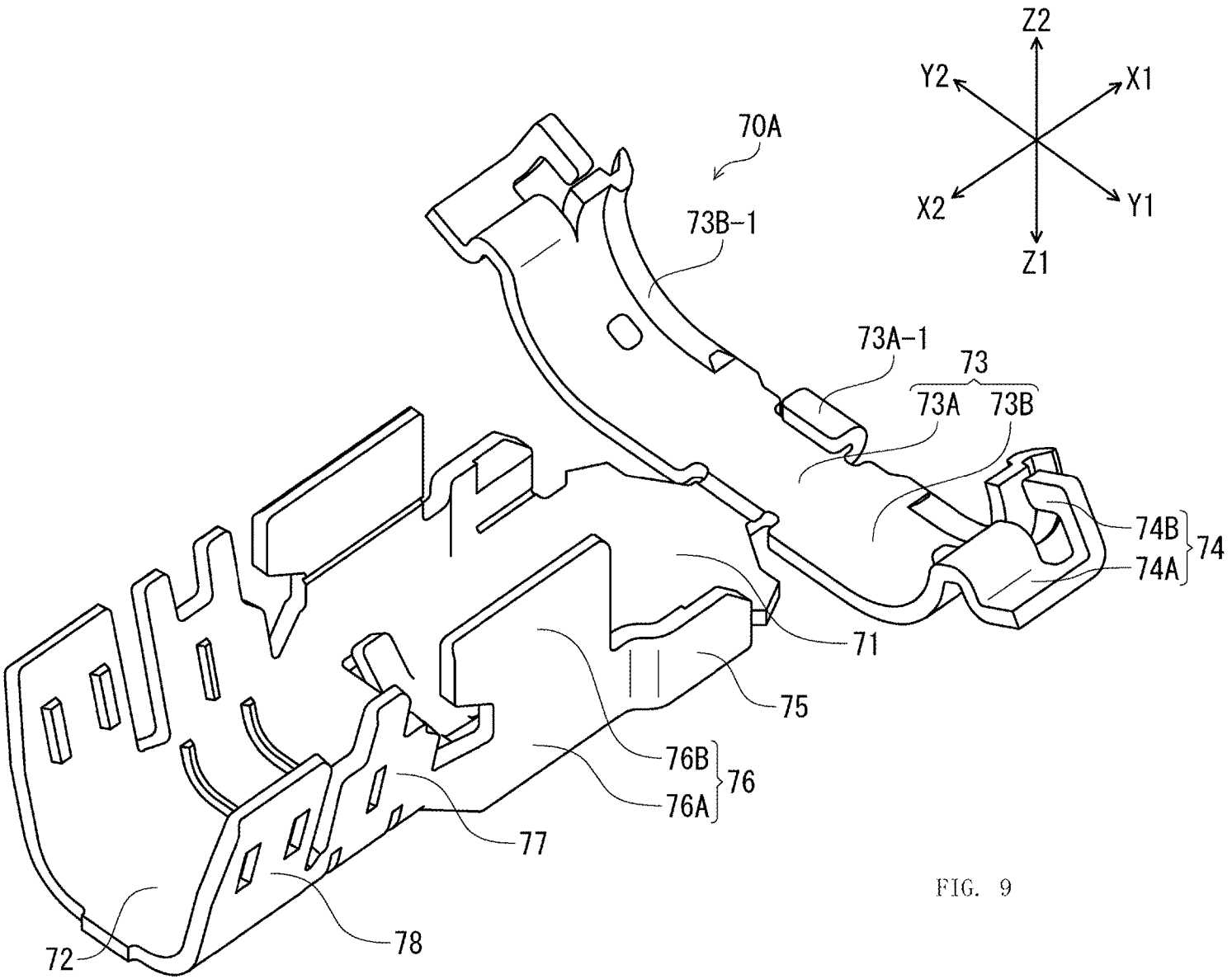
FIG. 9 illustrates an oblique view showing the first intermediate member of the plug outer conductor.
Figures 10A, 10B:
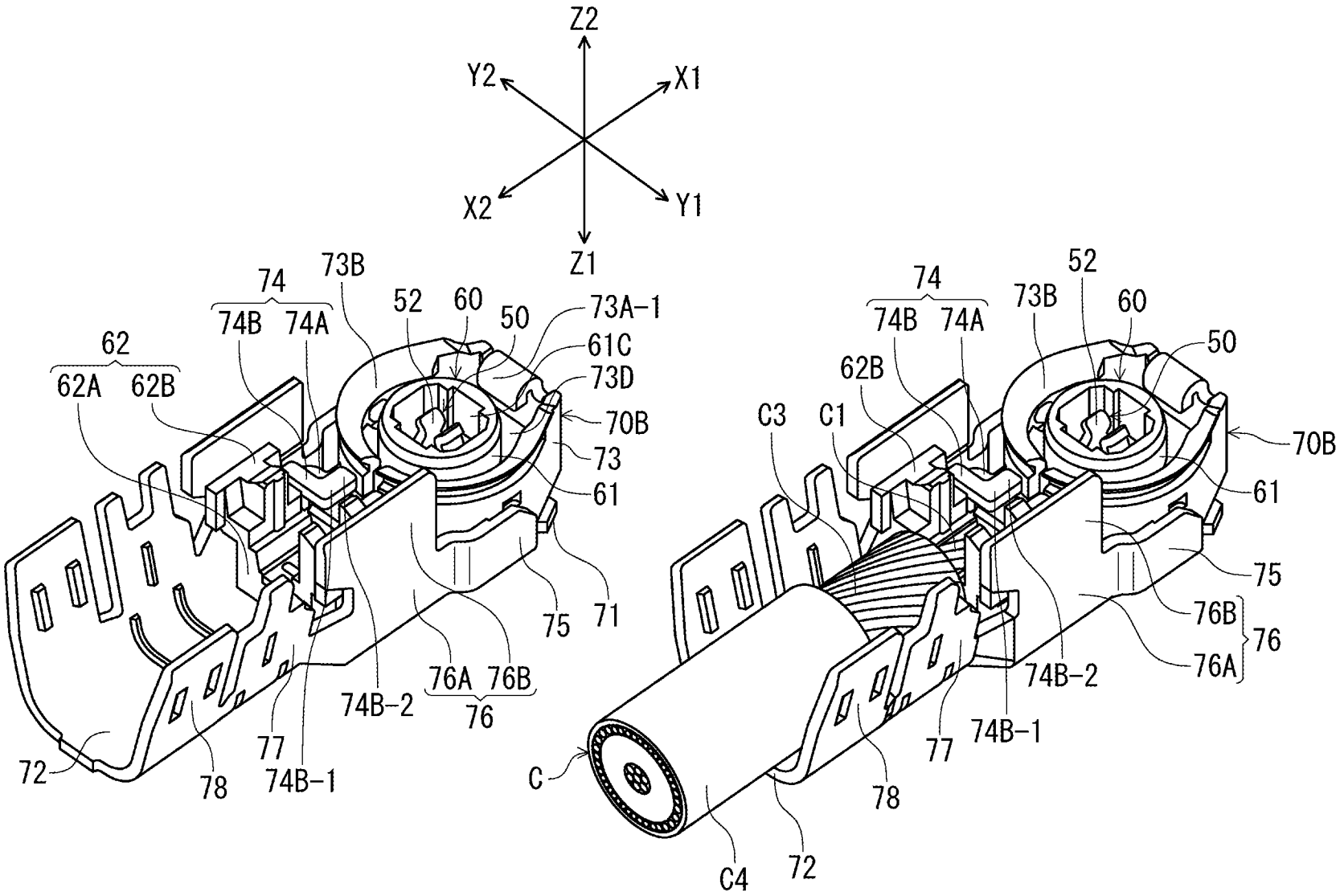
FIG. 10(A) illustrates an oblique view showing the arrangement of the internal dielectric body that secures the plug inner conductor of FIG. 8(B) in place in the second intermediate member of the plug outer conductor.
FIG. 10(B) is an oblique view showing a state in which a cable has been connected to the plug inner conductor of FIG. 10(A).

As can be seen in FIG. 7 and FIGS. 10(A) and 10(B), the arm-shaped portions 74 have base arm portions 74A that extend rearwardly from the rear end portions of the curved plate portions 73B, and resilient arm portions 74B coupled to the rear end portions of the base arm portions 74A inwardly of the base arm portion 74A in the connector width direction (see also FIG. 9). As can be seen in FIGS. 10(A) and 10(B), the resilient arm portions 74B have an L-shaped configuration when viewed in the up-down direction and have rear contact portions 74B-1 that are bent at the top edges of the rear end portions of the base arm portions 74A and extend inwardly in the connector width direction, and front contact portions 74B-2 that extend forwardly from the inner end portions of the rear contact portions 74B-1 in the connector width direction. In other words, along with having said front contact portions 74B-2 in the front end portion thereof, the resilient arm portions 74B have rear contact portions 74B-1 located in the rear end portions located rearwardly of the front contact portions 74B-2.

As can be seen in FIG. 3, the rear contact portions 74B-1 are enabled for contact with the hereinafter-described end plate portions 76B of the cover plate portions 76 through the medium of their bottom faces (top faces in FIGS. 10(A) and 10(B)). In addition, as described hereinafter, when the connectors are in a mated state, the front contact portions 74B-2, through the medium of their front end faces (through-thickness faces), are enabled for contact with the exterior peripheral surface of the rear end portions of the curved plate portions 73B (see FIG. 4(B)). The resilient arm portions 74B are enabled for resilient displacement in the up-down direction (Z-axis direction) and in the forward-backward direction (Y-axis direction). Due to the fact that the resilient arm portions 74B are enabled for resilient displacement in the up-down direction, the rear contact portions 74B-1 can contact the end plate portions 76B with adequate contact pressure. In addition, due to the fact that the resilient arm portions 74B are enabled for resilient displacement in the forward-backward direction, the front contact portions 74B-2 can contact the rear end portions of the curved plate portions 73B with adequate contact pressure.

Since in the present embodiment, as can be seen in FIG. 7, the front contact portions 74B-2 of the resilient arm portions 74B of the arm-shaped portions 74 are adapted to be located between the cover plate portions 76 and the mating body portion 73 in the forward-backward direction, the gap that was formed between the mating body portion 73 and the cover plate portions 76 in the past is covered by the front contact portions 74B-2, thereby achieving enhanced shielding properties.

The front lateral plate portions 75 have major faces perpendicular to the connector width direction and, as can be seen in FIG. 7, oppose the exterior peripheral surface of the curved plate portions 73B of the mating body portion 73 at a location outward of the mating body portion 73 in the connector width direction. As can be seen in FIG. 1 and FIG. 2, the front lateral plate portions 75 are coupled to the front ends of the hereinafter-described rear lateral plate portions 76A of the cover plate portions 76.

The cover plate portions 76 are located rearwardly of the mating body portion 73, with a gap left between them and said mating body portion 73 (see FIG. 7). The cover plate portions 76 are located within a range that includes the junction section of the interconnect portion 53 of the plug inner conductor 50 and the core wire C1 of the cable C in the forward-backward direction and ensures shielding properties by covering said junction section. As can be seen in FIG. 2, the cover plate portions 76 have rear lateral plate portions 76A that have major faces perpendicular to the connector width direction, and end plate portions 76B that are bent at the top edges of the rear lateral plate portions 76A and have major faces that extend inwardly in the connector width direction and are perpendicular to the up-down direction. The end plate portions 76B push the pressure contact portions 62B of the dielectric body 60 toward the junction section such that said pressure contact portions 62B are displaced and collapse inwardly in the connector width direction, thereby firmly securing the junction section in place with said pressure contact portions 62B.

The shield retaining portions 77 are located rearward of the cover plate portions 76 within a range that includes part of the exposed shield wire C3 of the cable C. As a result of crimping against this exposed shield wire C3, the shield retaining portions 77 secure said shield wire C3 in place and, at the same time, create a state permitting electrical communication with said shield wire C3.

The cable retaining portions 78 are located rearward of the shield retaining portions 77 within a range that includes the front end portion of the jacket C4 of the cable C. As a result of crimping against the front end portion of the jacket C4, the cable retaining portions 78 secure said cable C in place.

The plug connector 2 of the above configuration is fabricated in accordance with the following procedure. First, the plug inner conductor 50 illustrated in FIG. 8(A) is placed in a mold (not shown) and molten dielectric material (resin material) is injected into the cavity of the mold and allowed to solidify, thereby molding a dielectric body 60. As a result, as can be seen in FIG. 8(B), the plug inner conductor 50 is secured in place by the dielectric body 60 via unitary co-molding. Specifically, the strip portion 51 of the plug inner conductor 50 is secured in place by the large diameter portion 61A of the dielectric body 60 and the interconnect portion 53 of the plug inner conductor 50 is secured in place by the base portion 62A of the dielectric body 60 (see also FIG. 3).

Next, before the plug outer conductor 70 is formed by bending, a metal sheet member is prepared. The metal sheet member is bent at right angles at locations corresponding to the opposed lateral edge portions of the backplate portion 72 and the cover portion 71 (edge portions extending in the forward-backward direction) to form a first intermediate member 70A such as the one illustrated in FIG. 9. Next, the dielectric body 60 is placed on the first intermediate member 70A. At such time, the dielectric body 60 is disposed such that the stepped tubular portion 61 of the dielectric body 60 is located above the cover portion 71 of the first intermediate member 70A, and the interconnect retaining portion 62 is located above the front half of the backplate portion 72. Furthermore, the mating body portion 73 and the arm-shaped portions 74 are formed by bending the front end section of the first intermediate member 70A, thereby forming a second intermediate member 70B such as the one illustrated in FIG. 10(A). As a result, the stepped tubular portion 61 of the dielectric body 60 is held within the mating body portion 73. In addition, an annular external receiving portion 73D is formed between the inner peripheral surface of the mating body portion 73 and the exterior peripheral surface of the stepped tubular portion 61.

Next, as can be seen in FIG. 10(B), the front end portion of the cable C is disposed on the backplate portion 72. At such time, the core wire C1 exposed in the front end portion of the cable C is disposed on the exposed major face of the rear half of the interconnect portion 53 of the plug inner conductor 50 (see FIG. 3). Subsequently, the core wire C1 is solder-connected to the interconnect portion 53. Next, as can be seen in FIG. 11(A), the cover plate portions 76, shield retaining portions 77, and cable retaining portions 78 are formed by partially bending the plug outer conductor 70. As a result, the end plate portions 76B of the cover plate portions 76 push the pressure contact portions 62B of the dielectric body 60 toward the junction section, and the junction section is firmly secured in place by the pressure contact portions 62B (see FIG. 3).

Figure 11B:
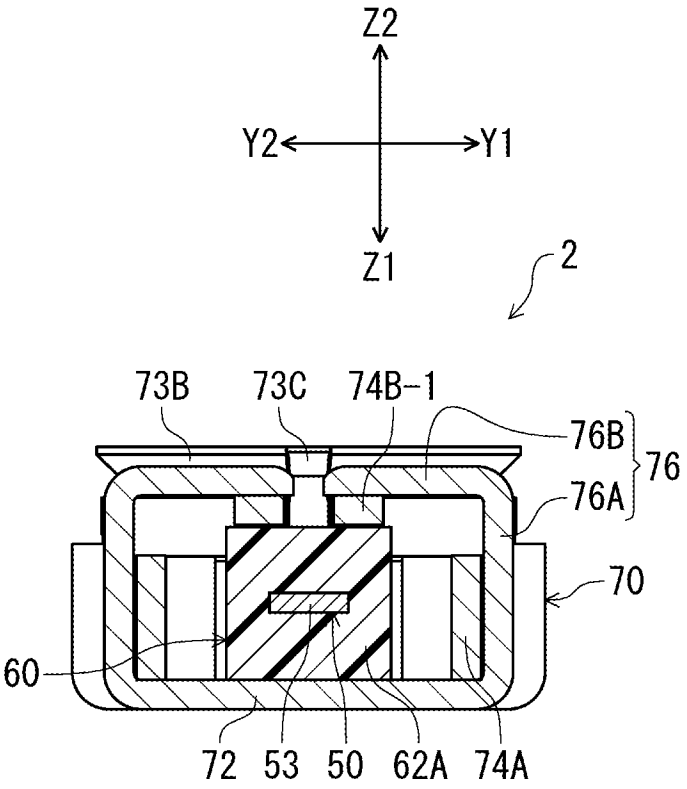
FIG. 11(B) is an XIB-XIB cross-sectional view of the plug coaxial electrical connector of FIG. 7.
Figure 11A:
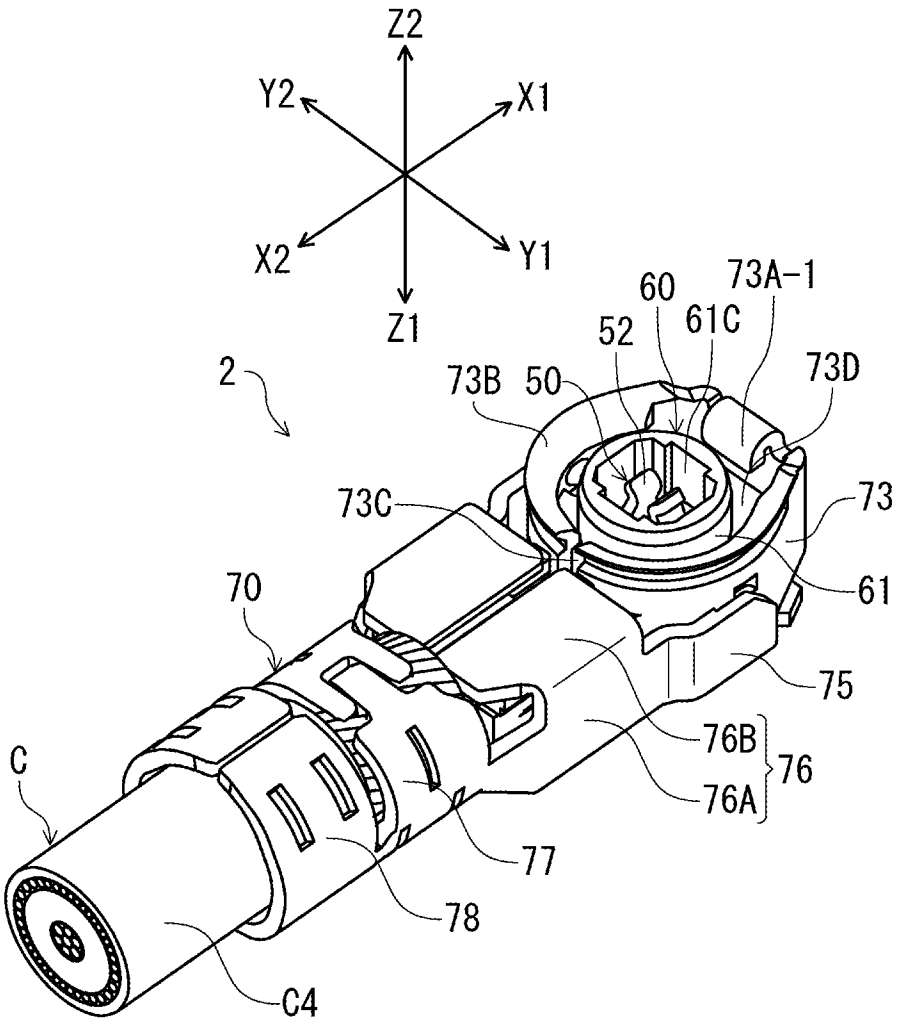
FIG. 11(A) illustrates an oblique view of a plug coaxial electrical connector finished by bending a portion of the second intermediate member of FIG. 10(B)

In addition, as can be seen in FIG. 11(B), which is an XIB-XIB cross-sectional view of FIG. 7, the bottom faces (major faces) of the end plate portions 76B are placed in contact with the top faces (major faces) of the rear contact portions 74B-1 of the arm-shaped portions 74 under contact pressure to create a state permitting electrical communication. Furthermore, as can be seen in FIG. 11(A), the shield retaining portions 77 are crimped against the exposed shield wire C3 to thereby secure said shield wire C3 in place and, at the same time, create a state permitting electrical communication with said shield wire C3. In addition, the cable retaining portion 78 are crimped against the front end portion of the jacket C4 to secure said cable C in place. This completes the manufacture of the plug connector 2.

The receptacle connector 1 and the plug connector 2 of the above configuration are matingly connected in accordance with the following procedure. First, as can be seen in FIG. 1 and FIG. 3, the receptacle connector 1 is disposed on the mounting face of circuit board B, and, as can be seen in FIG. 3, the connecting portion 22A of the receptacle inner conductor 20 is solder-connected to the signal circuits B2 while the ledge portion 12 of the receptacle outer conductor 10 is solder-connected to the ground circuits B1, thereby mounting the receptacle connector 1 to circuit board B. Next, as can be seen in FIG. 1 and FIG. 3, the receptacle connector 1 is positioned in an orientation wherein the receiving portion 33 is upwardly open while the plug connector 2 is positioned above the receptacle connector 1 in an orientation wherein the inner receiving portion 61C (see FIG. 3) and the external receiving portion 73D (see FIG. 3) of said plug connector 2 are facing downwards.

Next, the plug connector 2 is lowered and matingly connected to the receptacle connector 1 from above. At such time, as can be seen in FIG. 4(B), the tubular portion 11 of the receptacle outer conductor 10 of the receptacle connector 1 enters the external receiving portion 73D of the plug connector 2 from below. As a result, the external contact portion 11A of the receptacle outer conductor 10, on the one hand, and the first external contact portion 73A-1 and the second external contact portions 73B-1 of the plug outer conductor 70, on the other hand, are brought into contact under contact pressure and placed in electrical communication. At such time, the external contact portion 11A is engaged with the first external contact portion 73A-1 and the second external contact portion 72A in the up-down direction and locked therewith, which prevents inadvertent decoupling of the connectors. In addition, the internal contact portion 21A of the receptacle inner conductor 20 enters between the pair of internal contact portions 52 of the plug inner conductor 50 from below, and is clamped by the contact protrusions 52A of said internal contact portions 52, thereby placing the internal contact portion 21A and the internal contact portions 52 in electrical communication. This completes the operation of mating of the connectors.

In addition, in the present embodiment, when the tubular portion 11 of the receptacle outer conductor 10 enters the external receiving portion 73D of the plug connector 2, the curved plate portions 73B of the plug connector 2 are resiliently displaced so as to expand outwardly in the radial direction of the mating body portion 73. As a result, as can be seen in FIG. 4(B), curved plate portions 73B come into contact with the front contact portions 74B-2 of the arm-shaped portions 74 of the plug outer conductor 70 under contact pressure from the front. In addition, since the rear contact portions 74B-1 of the arm-shaped portions 74 are in contact with the end plate portions 76B of the cover plate portions 76 (see FIG. 11(B)), when the connectors are in a mated state, the contact between the curved plate portions 73B and the front contact portions 74B-2 places the receptacle outer conductor 10 and the cover plate portions 76 in electrical communication through the medium of the curved plate portions 73B, front contact portions 74B-2, and rear contact portions 74B-1. As a result, a return path is formed that goes through the receptacle outer conductor 10, resilient arm portions 74B of the arm-shaped portions 74, and cover plate portions 76. Namely, in the present embodiment, when the junction section of the interconnect portion 53 of the plug inner conductor 50 and the cable C is viewed in the forward-backward direction (X-axis direction), there is a return path extending in the forward-backward direction so as to surround said junction section, as a result of which shielding properties are greatly enhanced.

Second Embodiment

In the first embodiment, the plug outer conductor 70 of the plug connector 2 had arm-shaped portions 74 that extended from the mating body portion 73, and a return path was formed by bringing the resilient arm portions 74B of said arm-shaped portions 74 into contact with the mating body portion 73 and the end plate portions 76B. By contrast, the present embodiment differs from the first embodiment in that the return path is formed as a result of bringing the contact pieces provided in the end plate portions of the cover plate portions into contact with the receptacle outer conductor.

The receptacle connector of the present embodiment has the same configuration as the receptacle connector 1 of the first embodiment. In addition, with the exception of the plug outer conductor, the plug connector of the present embodiment has the same configuration as the plug connector 2 of the first embodiment. In the present embodiment, the plug connector is discussed with emphasis on differences from the first embodiment, and parts identical to the respective components used in the first embodiment are assigned numerals obtained by adding "100" to the numerals used in the first embodiment and further discussion thereof is omitted.

Figure 12B:
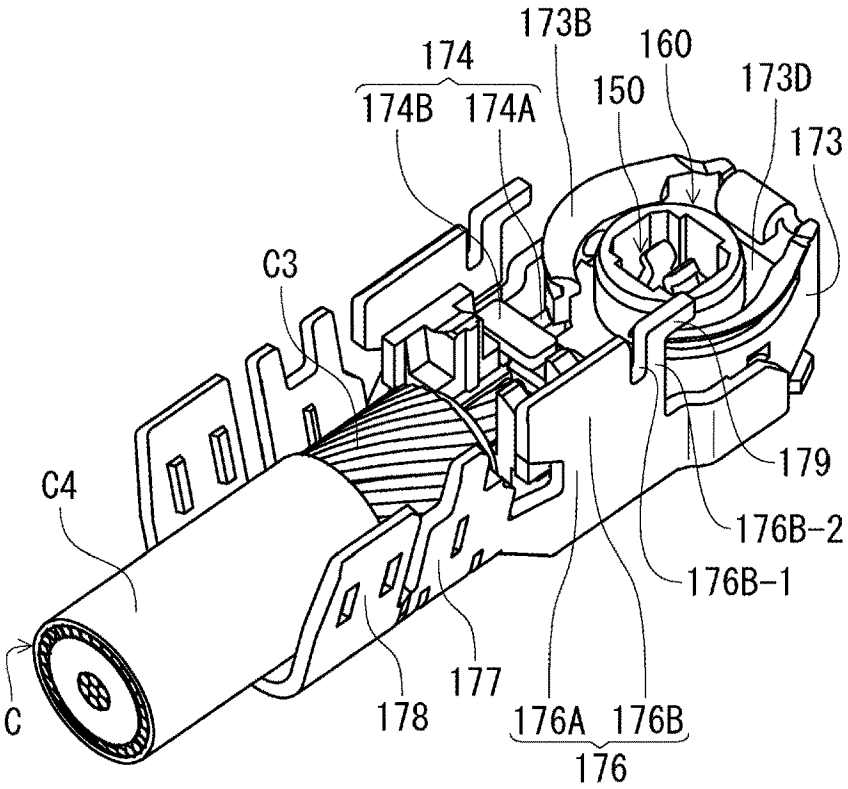
FIG. 12(B) illustrates an oblique view of a state prior to folding the cover plate portions, shield retaining portions, and cable retaining portions of the plug outer conductor of the plug coaxial electrical connector illustrated in FIG. 12(A).
Figure 12A:
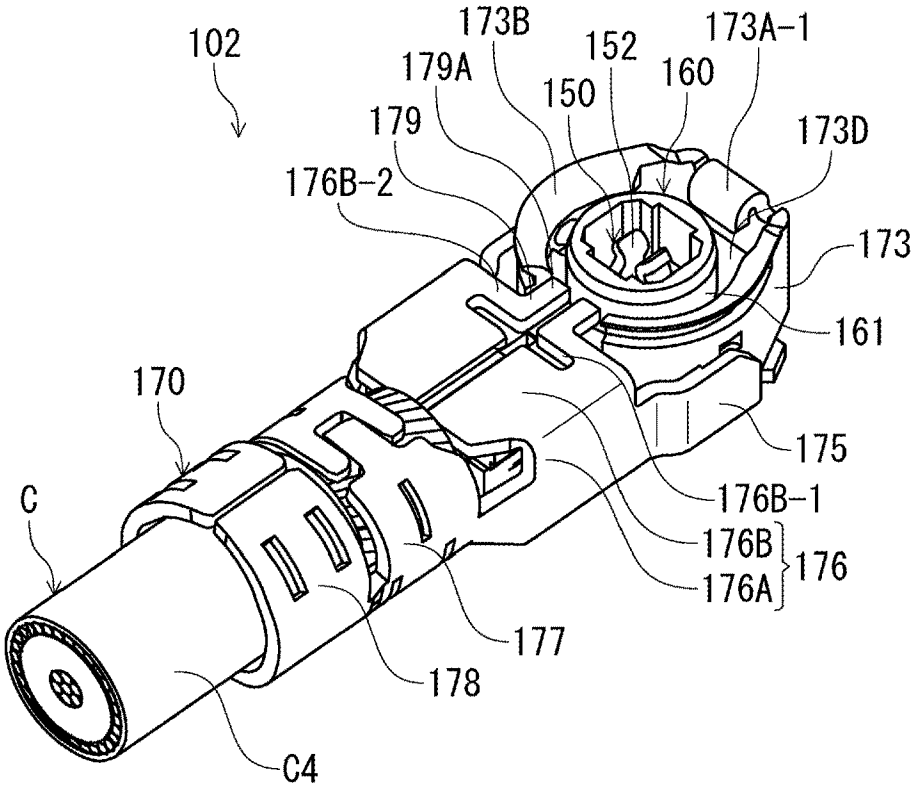
FIG. 12(A) illustrates an oblique view of the plug coaxial electrical connector according to the second embodiment.
Figure 13B:
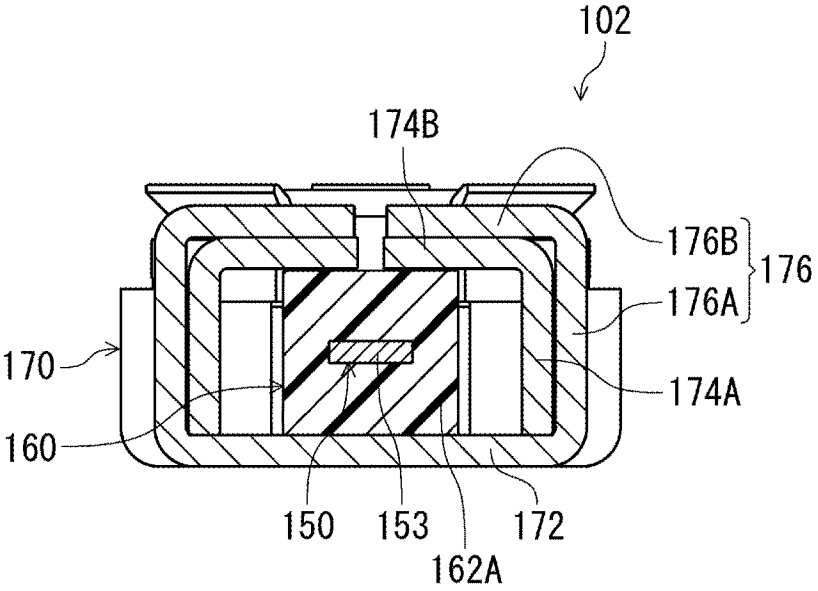
FIG. 13(B) illustrates a cross-sectional view of the plug coaxial electrical connector of FIG. 13(A) taken along line XIIIB-XIIIB
Figure 13A:
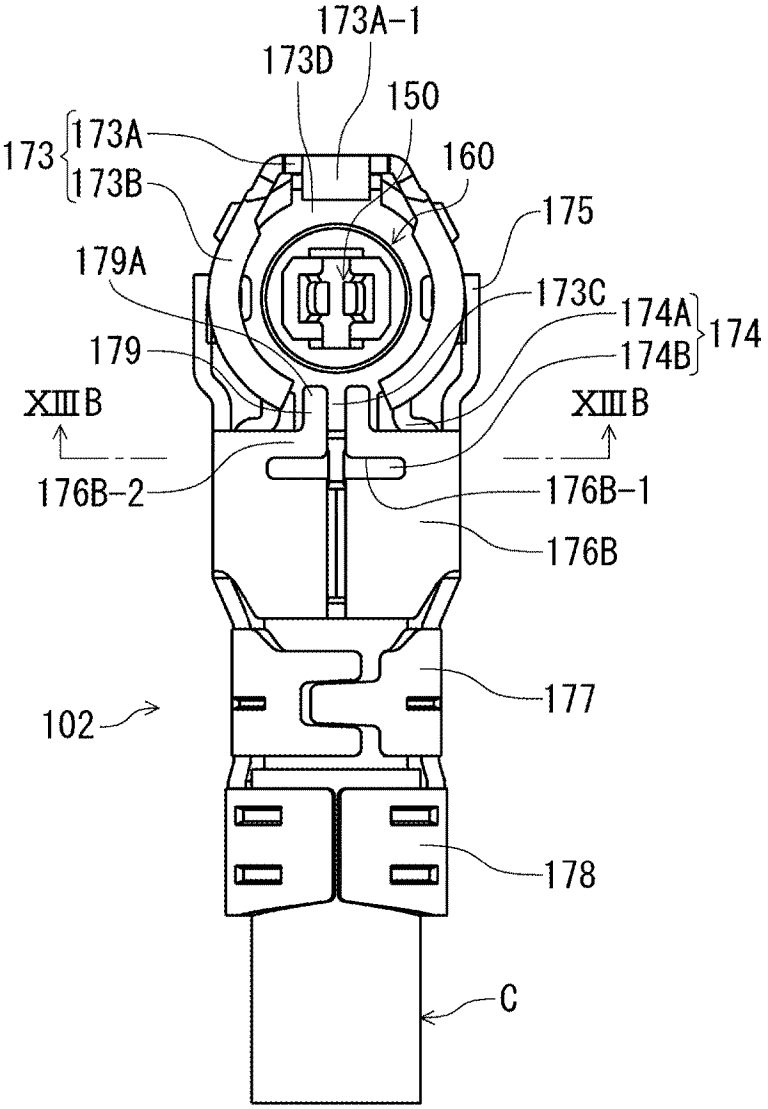
FIG. 13(A) illustrates a plan view of the plug coaxial electrical connector of FIG. 12(A) seen from above.

FIG. 12(A) is an oblique view of the plug connector 102 according to the present embodiment, and FIG. 12(B) is an oblique view of a state prior to folding the cover plate portions 176, shield retaining portions 177, and cable retaining portions 178 of the plug outer conductor 170 of the plug connector 102 illustrated in FIG. 12(A). FIG. 13(A) is a plan view of the plug connector 102 of FIG. 12(A) seen from above, and FIG. 13(B) is a cross-sectional view of the plug connector 102 of FIG. 13(A) taken along line XIIIB-XIIIB Although in the present embodiment the mating body portion 173 of the plug outer conductor 170 of the plug connector 102 has a pair of curved plate portions 173B in the same manner as in the first embodiment, as can be seen in FIG. 13(A), the gap 173C formed between the rear ends of the curved plate portions 173B is larger than the gap 73C in the first embodiment (see FIG. 7 and FIG. 11(A), etc.).

As can be seen in FIG. 12(B) and FIG. 13(A), the arm-shaped portions 174 have base arm portions 174A that have major faces perpendicular to the connector width direction and extend rearwardly from the rear ends of the curved plate portions 173B, and inner plate portions 174B that are bent at the top edges of sections proximate to the rear ends of the base arm portions 174A and extend inwardly in the connector width direction. As can be seen in FIG. 13(A), the inner plate portions 174B are located within a range that includes the hereinafter-described slits 176B-1 of the end plate portions 176B in the forward-backward direction and the connector width direction. In addition, in the inner plate portions 174B, the major faces of the sections located within the extent of overlap with the end plate portions 176B at the periphery of the slits 176B-1 when viewed in the up-down direction are brought into contact with the major faces of the end plate portions 176B and thus enabled for electrical communication (see FIG. 13(B)).

In the same manner as in the first embodiment, the cover plate portions 176 have rear lateral plate portions 176A and end plate portions 176B. The end plate portions 176B of present embodiment have formed therein slits 176B-1 that extend in the connector width direction at locations proximate to the front ends of said end plate portions 176B as seen in FIG. 12(A) and FIG. 13(A) as well as resilient pieces 176B-2 that extend inwardly in the connector width direction along said slits 176B-1 at locations forward of said slits 176B-1. Said resilient pieces 176B-2 are resiliently displaceable in the forward-backward direction. In the present embodiment, the degradation of shielding properties due to the formation of the slits 176B-1 in the end plate portions 176B can be minimized because the slits 176B-1 are blocked (see FIG. 13(A)) by the inner plate portions 174B when the plug connector 102 is viewed in the up-down direction.

Contact pieces 179 extend forwardly from the front edges of the distal end portions of the resilient pieces 176B-2. The contact pieces 179 are enabled for resilient displacement in the forward-backward direction. As can be seen in FIG. 13(A), the front end portions of the contact pieces 179 are introduced into the gap 173C of the mating body portion 173. Therefore, the degradation of shielding properties due to the presence of the gap 173C in the mating body portion 173 is minimized. The front end portions of the contact pieces 179 constitute front contact portions 179A enabled to contact the tubular portion 11 of the receptacle outer conductor 10 (counterpart outer conductor) when the connectors are in a mated state. The front contact portions 179A can be displaced in the forward-backward direction as a result of the resilient displacement of the resilient pieces 176B-2 and can contact the tubular portion 11 under sufficient contact pressure as a result of such displacement.

When the receptacle connector 1 is matingly connected to the plug connector 102 of the present embodiment and, as described above, the front contact portions 179A of the contact pieces 179 of the plug outer conductor 170 are brought into contact with the tubular portion 11 of the receptacle outer conductor 10, a return path through the tubular portion 11, contact pieces 179 and end plate portions 176B is formed and shielding properties are enhanced. In addition, in the present embodiment, shielding properties are further enhanced because the contact pieces 179 are located in the gap between the mating body portion 173 and the end plate portions 176B in the forward-backward direction and cover said gap.

Third Embodiment

In the first embodiment, the plug outer conductor 70 of the plug connector 2 had arm-shaped portions 74 that extended from the mating body portion 73, and a return path was formed by bringing the resilient arm portions 74B of said arm-shaped portions 74 into contact with the mating body portion 73 and the end plate portions 76B. By contrast, the present embodiment differs from the first embodiment in that a metal intermediate member separate from the plug outer conductor is mounted to the cover plate portions of the plug outer conductor and a return path is formed by bringing said intermediate member into contact with the mating body portion and the cover plate portions.

The receptacle connector of the present embodiment has the same configuration as the receptacle connector 1 of the first embodiment. In addition, with the exception of providing the intermediate member and the shape of the plug outer conductor, the plug connector of the present embodiment has the same configuration as the plug connector of the first embodiment. In the present embodiment, the plug connector is discussed with emphasis on differences from the first embodiment, and parts identical to the respective components used in the first embodiment are assigned numerals obtained by adding "200" to the numerals used in the first embodiment and further discussion thereof is omitted.

Figure 14B:
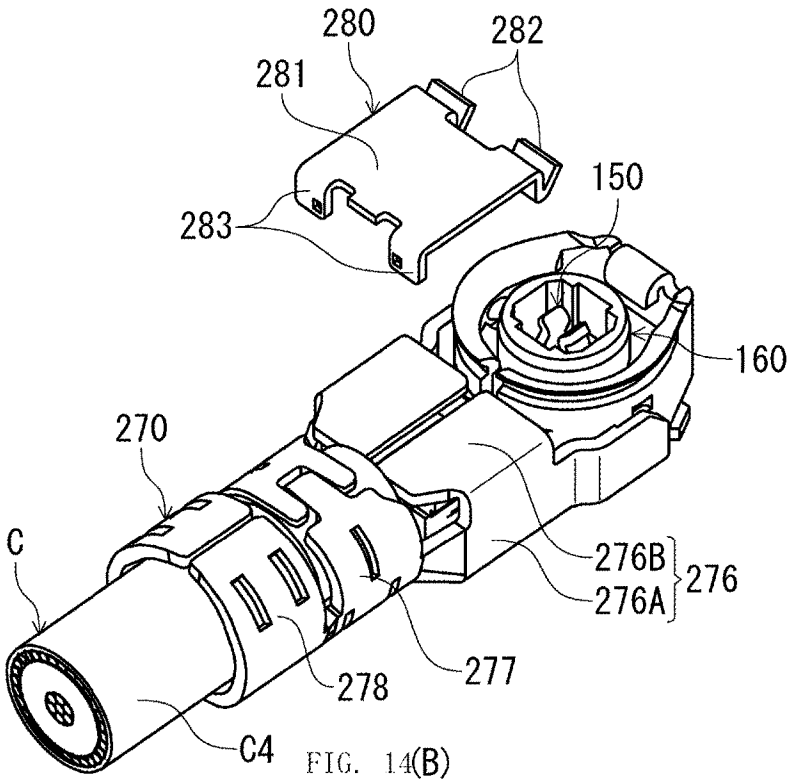
FIG. 14(B) illustrates an oblique view of the plug coaxial electrical connector illustrated in FIG. 14(A) with the intermediate member shown separately.
Figure 14A:
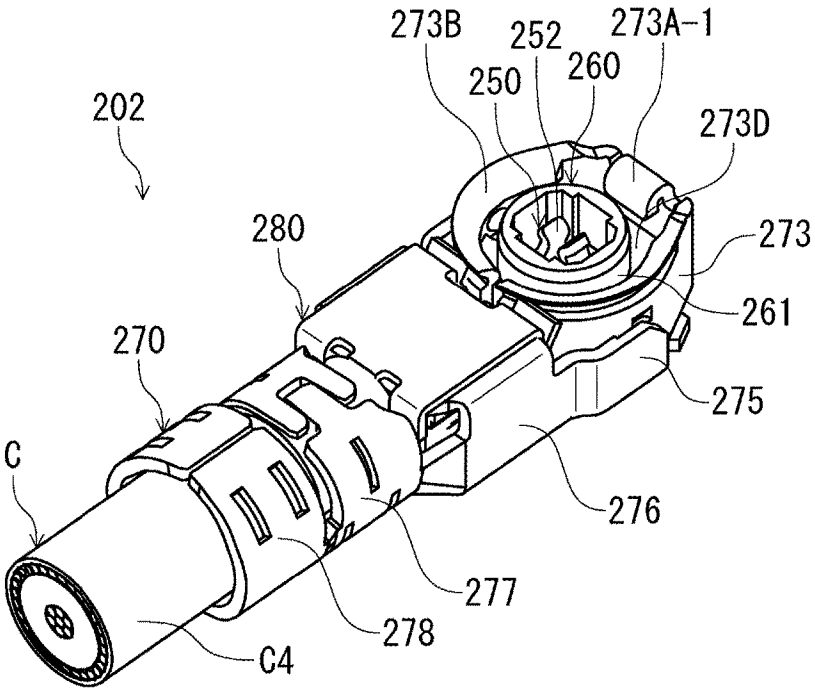
FIG. 14(A) illustrates an oblique view of the plug coaxial electrical connector according to the third embodiment.
Figure 14C:
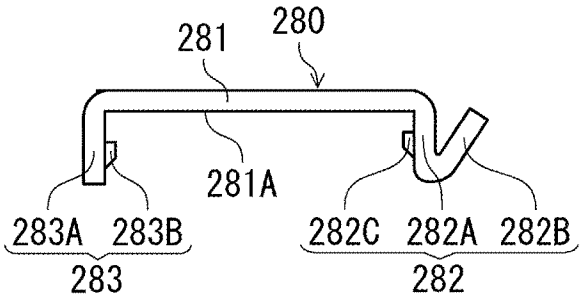
FIG. 14(C) illustrates a side view of the intermediate member.

FIG. 14(A) is an oblique view of the plug connector 202 according to the present embodiment, FIG. 14(B) is an oblique view of the plug connector 202 of FIG. 14(A) with the intermediate member 280 shown separately, and FIG. 14(C) is a side view of the intermediate member 280.

In the present embodiment, the shape of the plug outer conductor 270 of the plug connector 202 is obtained by removing the arm-shaped portions 74 from the plug outer conductor 70 of the first embodiment.

The intermediate member 280, which is made by bending a portion of a metal sheet member in the through-thickness direction, has a planar main body portion 281 that has a major face extending along the major faces (faces perpendicular to the through-thickness faces) of the end plate portions 276B of the plug outer conductor 270, two front leg portions 282 that extend from the front end edge of the main body portion 281, and two rear leg portions 283 that extend from the rear end edge of the main body portion 281.

The main body portion 281 has a quadrangular major face covering substantially the entire area of the major faces of the pair of end plate portions 276B, and the major face opposing said end plate portions 276B (bottom face in FIGS. 14 (A-C)) constitutes a rear contact portion 281A intended for contacting the end plate portions 276B. As can be seen in FIG. 14(C), the front leg portions 282 have front base leg portions 282A, which are bent at a right angle at the front end edge of the main body portion 281 and extend downwards, front contact pieces 282B serving as front contact portions, which extend forwardly and upwardly from the bottom ends of the front base leg portions 282A, and front engaging portions 282C, which protrude from the rear faces of the front base leg portions 282A.

The front contact pieces 282B are resiliently displaceable in the forward-backward direction, and, as can be seen in FIG. 14(A), are enabled to contact the exterior peripheral surface of the curved plate portions 273B of the mating body portion 273 with their front faces (major faces) under contact pressure. As can be seen in FIG. 14(C), the front engaging portions 282C are located below the bottom face of the main body portion 281, in other words, below the rear contact portion 281A, and are adapted to engage the front end portions of the end plate portions 276B from below when the intermediate member 280 is mounted to the end plate portions 276B.

As can be seen in FIG. 14(C), the rear leg portions 283 have rear base leg portions 283A that are bent at a right angle at the rear end edge of the main body portion 281 and extend downwardly, and rear engaging portions 283B that protrude from the front faces of the rear base leg portions 283A. As can be seen in FIG. 14(C), the rear engaging portions 283B are located below the bottom face of the main body portion 281, in other words, below the rear contact portion 281A, and are adapted to engage the rear end portions of the end plate portions 276B from below when the intermediate member 280 is mounted to the end plate portions 276B.

The thus-configured intermediate member 280 is mounted to the end plate portions 276B from above as seen in FIG. 14(B). When the intermediate member 280 is mounted to the end plate portions 276B, the front engaging portions 282C of the intermediate member 280 engage the front end portions of the end plate portions 276B while the rear engaging portions 283B engage the rear end portions of the end plate portions 276B. In addition, the front contact pieces 282B of the intermediate member 280 are brought into contact with the exterior peripheral surface of the curved plate portions 273B of the mating body portion 273 under contact pressure in a state of resilient deformation, and the rear contact portion 281A of the intermediate member 280 is placed in surface-to-surface contact with the major faces of the end plate portions 276B. As a result, when the connectors are in a mated state, the receptacle outer conductor 10 and the cover plate portions 276 are placed in electrical communication via the front contact pieces 282B and the rear contact portion 281A, thereby forming a return path through the receptacle outer conductor, mating body portion 273, intermediate member 280, and cover plate portions 276.

Although in the present embodiment the front contact pieces 282B of the intermediate member 280 are adapted to contact the mating body portion 273 of the plug outer conductor 270, as an alternative, the front contact pieces of the intermediate member may be configure to contact the tubular portion of the receptacle outer conductor when the connectors are in a mated state. In such a configuration, a return path is formed through the tubular portion, intermediate member and cover plate portions, thereby enhancing shielding properties.

Fourth Embodiment

In the first embodiment, the plug outer conductor 70 of the plug connector 2 had arm-shaped portions 74 that extended from the mating body portion 73, and a return path was formed by bringing the resilient arm portions 74B of said arm-shaped portions 74 into contact with the mating body portion 73 and the end plate portions 76B. By contrast, the present embodiment differs from the first embodiment in that the return path is formed as a result of bringing the resilient arm portions of the arm-shaped portions into contact with the ledge portion of the receptacle outer conductor.

The receptacle connector of the present embodiment has the same configuration as the receptacle connector 1 of the first embodiment. In addition, with the exception of the plug outer conductor, the plug connector of the present embodiment has the same configuration as the plug connector of the first embodiment. In the present embodiment, the plug connector is discussed with emphasis on differences from the first embodiment, and parts identical to the respective components used in the first embodiment are assigned numerals obtained by adding "300" to the numerals used in the first embodiment and further discussion thereof is omitted.

Figure 15B:
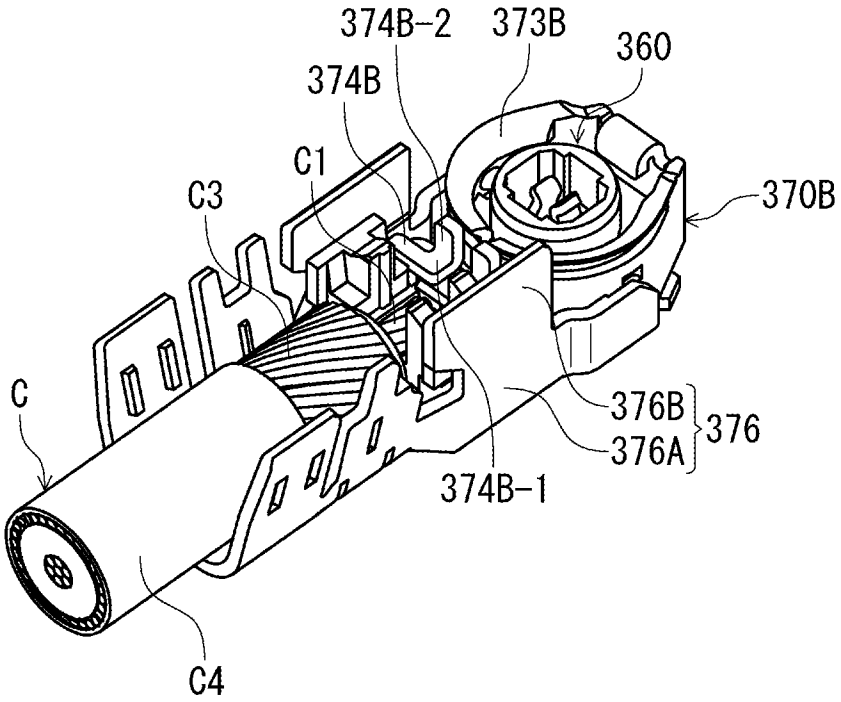
FIG. 15(B) illustrates an oblique view of a state prior to folding the cover plate portions, shield retaining portions, and cable retaining portions of the plug outer conductor of the coaxial electrical connector illustrated in FIG. 15(A).
Figure 15A:
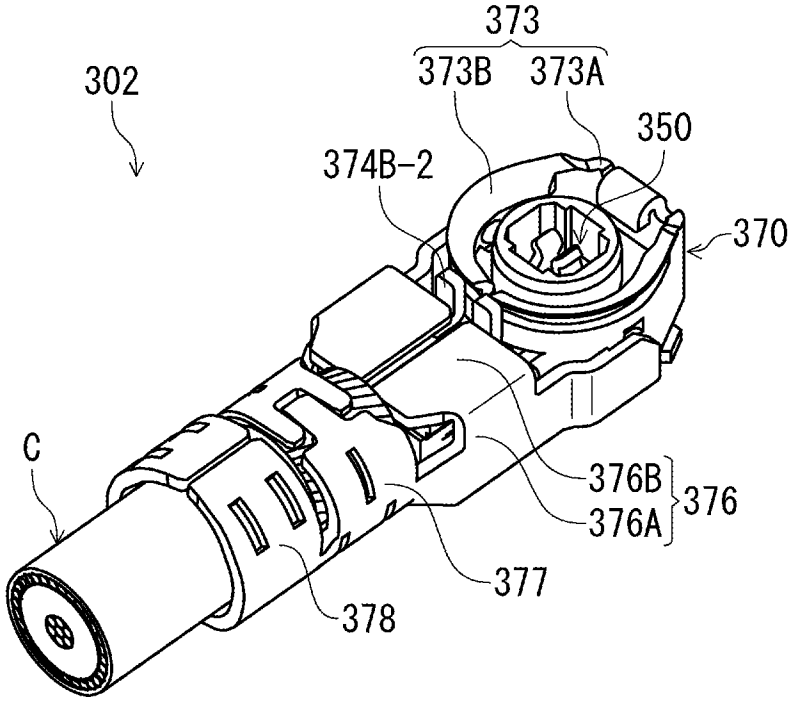
FIG. 15(A) illustrates an oblique view of the plug coaxial electrical connector according to the fourth embodiment.
Figure 16A:
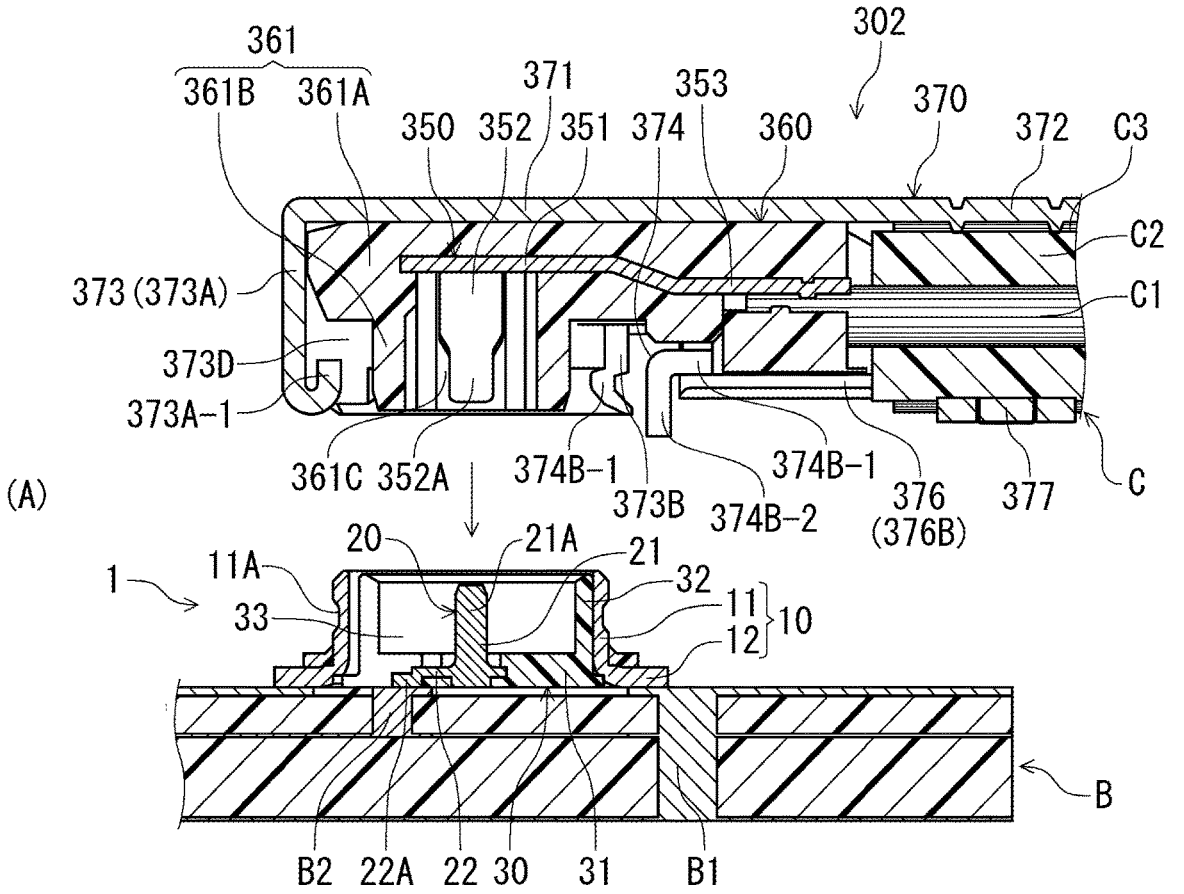
Figure 16B:
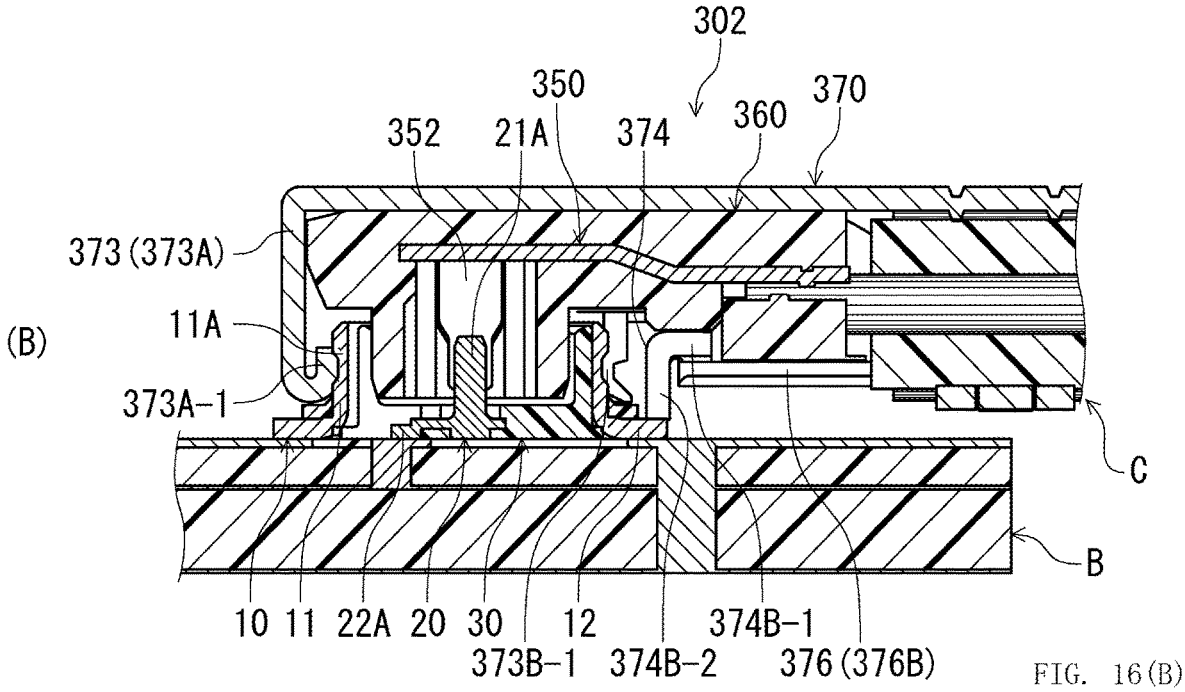

FIG. 15(A) is an oblique view of the plug connector according to the present embodiment, and FIG. 15(B) is an oblique view of a state prior to folding the cover plate portions, shield retaining portions, and cable retaining portions of the plug outer conductor of the plug connector illustrated in FIG. 15(A). FIGS. 16(A) and 16(B) shows cross-sectional views illustrating a connector assembly according to the present embodiment using cross-sections taken in a plane perpendicular to the connector width direction, wherein FIG. 16(A) shows a state immediately prior to connector mating, and FIG. 16(B) shows the connectors in a mated state.

As can be seen in FIG. 15(B), the resilient arm portions 374B of the arm-shaped portions 374 of the plug outer conductor 370 of the plug connector 302 according to the present embodiment are shaped by bending the front end portions of the resilient arm portions 74B of the arm-shaped portions 74 of the first embodiment (see FIGS. 10(A) and 10(B)) at a right angle in the through-thickness direction. The front end portions of the resilient arm portions 374B constitute front contact portions 374B-2 that extend in the up-down direction toward the receptacle connector 1, i.e., upwardly (Z2 direction) in FIG. 15(B), and are enabled to contact the ledge portion 12 of the receptacle outer conductor 10 of the receptacle connector 1 when the connectors are in a mated state (see FIG. 16(B)). As can be seen in FIG. 15(A) and FIG. 16(A), the front contact portions 374B-2 are located between the mating body portion 373 and the end plate portions 376B in the forward-backward direction.

As can be seen in FIG. 16(B), when the plug connector 302 according to the present embodiment is matingly connected to the receptacle connector 1, in the same manner as in the first embodiment, the mating body portion 373 of the plug outer conductor 370 and the tubular portion 11 of the receptacle outer conductor 10 are brought into contact, while the bottom end faces of the front contact portions 374B-2 of the plug outer conductor 370 are brought into contact with the top face of the ledge portion 12 of the receptacle outer conductor 10. In the present embodiment, the arm-shaped portions 374 are resiliently displaceable in the up-down direction, and the front contact portions 374B-2 are brought into contact with the ledge portion 12 under contact pressure.

In the present embodiment, bringing the front contact portions 374B-2 and the ledge portion 12 into contact places the receptacle outer conductor 10 and the cover plate portions 376 of the plug outer conductor 370 in electrical communication via the front contact portions 374B-2 and rear contact portions 374B-1, and, as a result, forms a return path through the receptacle outer conductor 10, arm-shaped portions 374 and cover plate portions 376, thereby enhancing shielding properties. In addition, in the present embodiment, shielding properties are further enhanced because the front contact portions 374B-2 are located in the gap between the mating body portion 373 and the end plate portions 376B in the forward-backward direction and cover said gap.

Figure 17A:
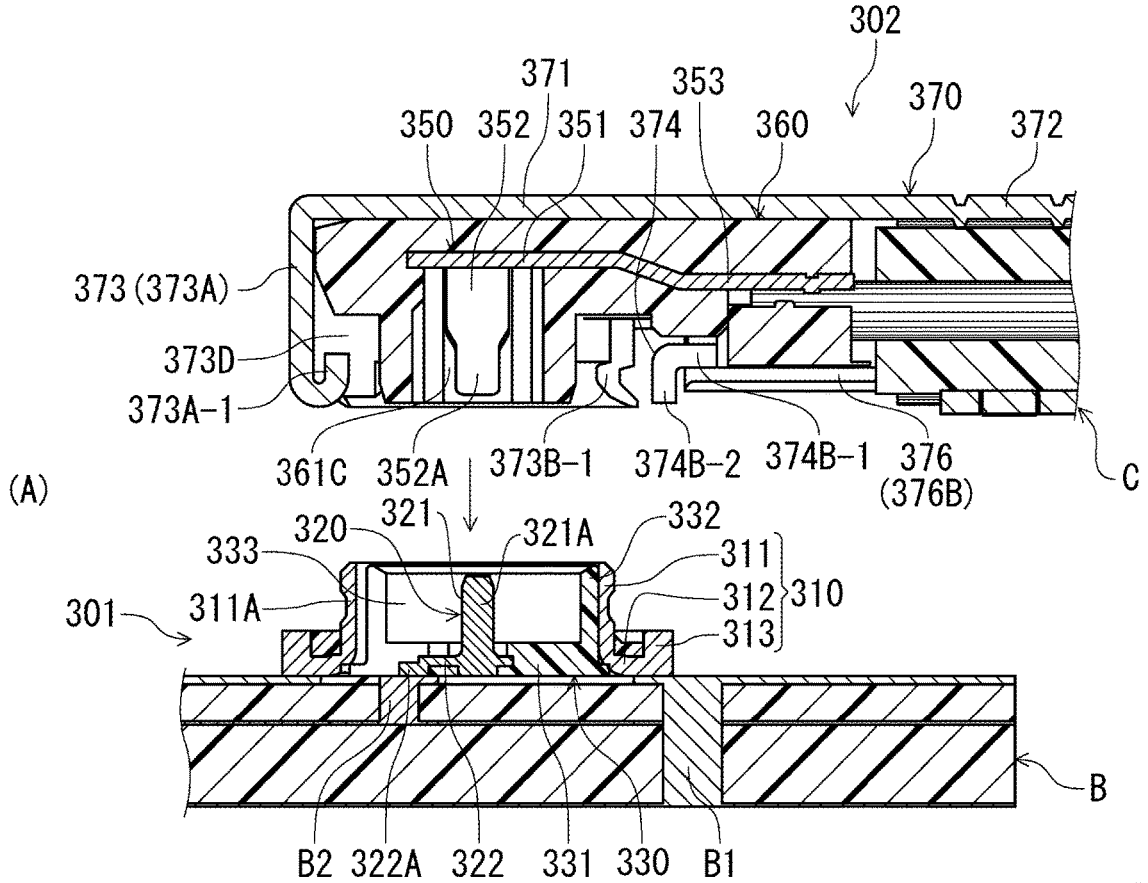
Figure 17B:
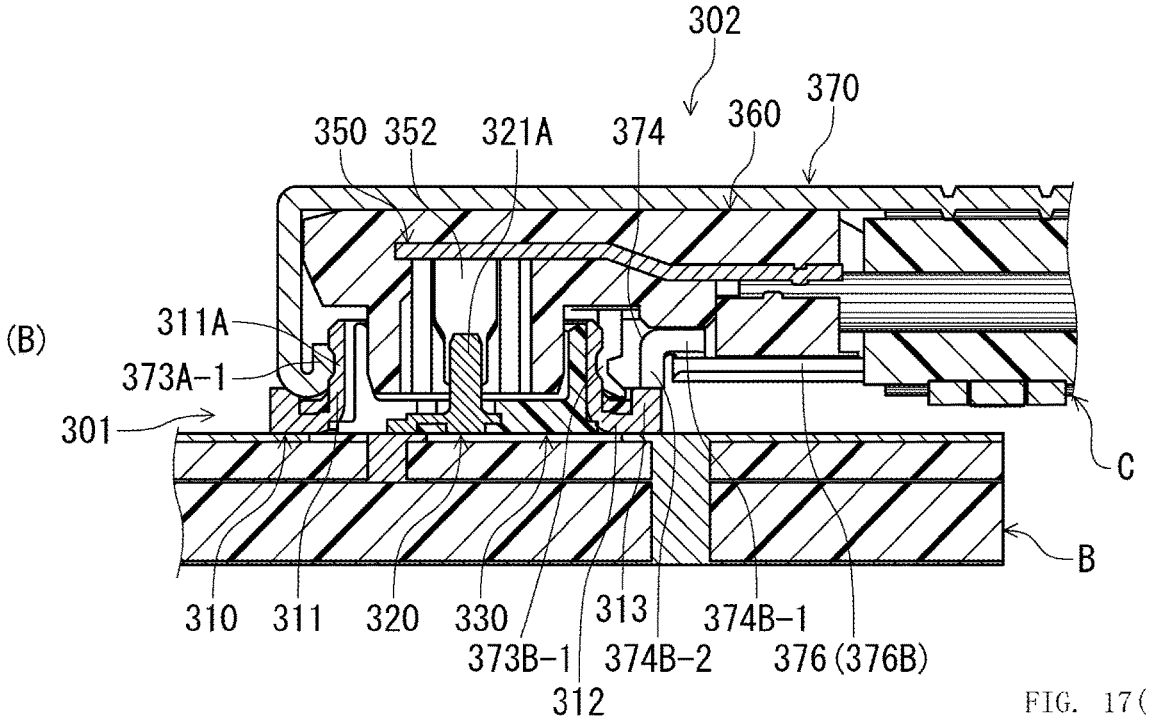

The present embodiment allows for a number of variations. FIGS. 17(A) and 17(B) shows cross-sectional views illustrating a connector assembly according to the present embodiment using cross-sections taken in a plane perpendicular to the connector width direction, wherein FIG. 17(A) shows a state immediately prior to connector mating, and FIG. 17(B) shows the connectors in a mated state. In FIGS. 17(A) and 17(B), the parts of the receptacle connector that are identical to the respective components used in the first embodiment are assigned numerals obtained by adding "300" to the numerals used in the first embodiment.

As can be seen in FIGS. 17(A) and 17(B), in this alternative example, a protruding wall portion 313 that rises from the ledge portion 312 while extending around the tubular portion 311 is formed in the receptacle outer conductor 310. The protruding wall portion 313 is located so as to have a clearance with said tubular portion 311 in the radial direction of the tubular portion 311, and is adapted to contact the first external contact portion 373A-1 and the front contact portions 374B-2 of the plug outer conductor 370 when the connectors are in a mated state. In this variation, the front contact portions 374B-2 are made shorter in comparison with the embodiment illustrated in FIG. 16(A, B) in exact proportion to the height dimension (dimension in the up-down direction) of the protruding wall portion 313.

As can be seen in FIG. 17(B), when the plug connector 302 according to this variation is matingly connected to the receptacle connector 1, the bottom end face of the first external contact portion 373A-1 of the plug outer conductor 370 and the bottom end faces of the front contact portions 374B-2 are brought into contact with the top end face of the protruding wall portion 313 of the receptacle outer conductor 310. Enhanced shielding properties are achieved in the same manner as in the embodiment illustrated in FIGS. 16(A) and 16(B).

Fifth Embodiment

In the first embodiment, the plug outer conductor 70 of the plug connector 2 had arm-shaped portions 74, and a return path was formed by bringing the resilient arm portions 74B of said arm-shaped portions 74 into contact with the mating body portion 73 and the end plate portions 76B. By contrast, the present embodiment differs from the first embodiment in that the return path is formed as a result of bringing the front contact portions provided in the arm-shaped portions into contact with the receptacle outer conductor.

The receptacle connector of the present embodiment has the same configuration as the receptacle connector 1 of the first embodiment. In addition, with the exception of the plug outer conductor, the plug connector of the present embodiment has the same configuration as the plug connector of the first embodiment. In the present embodiment, the discussion emphasizes differences from the first embodiment, and the parts of the plug connector that are identical to the respective components used in the first embodiment are assigned numerals obtained by adding "400" to the numerals used in the first embodiment and further discussion thereof is omitted.

Figure 18B:
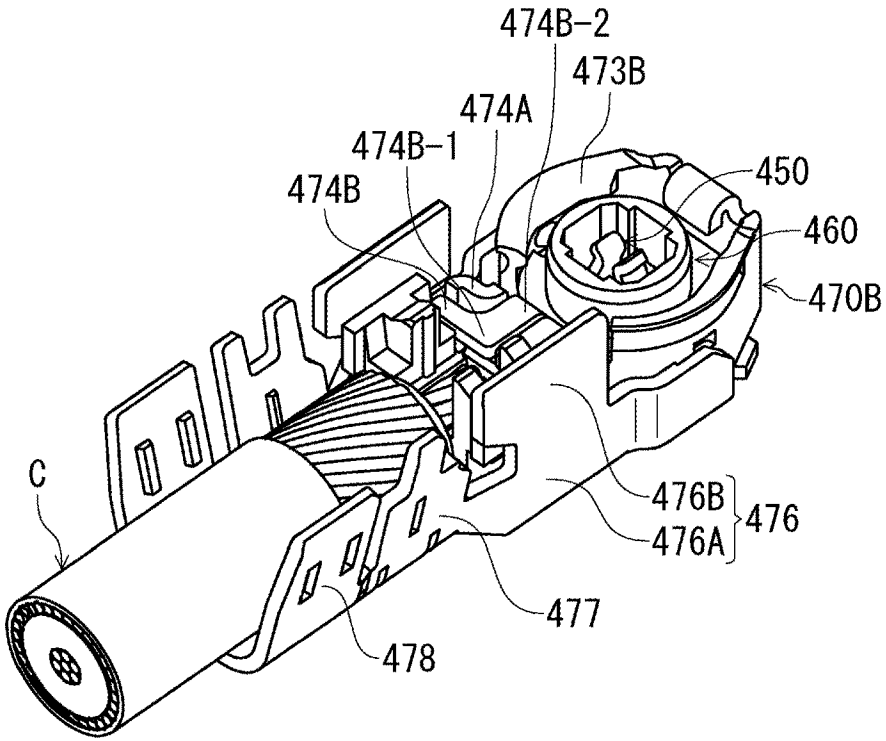
FIG. 18(B) illustrates an oblique view of a state prior to folding the cover plate portions, shield retaining portions, and cable retaining portions of the plug outer conductor of the plug coaxial electrical connector illustrated in FIG. 18(A).
Figure 18A:
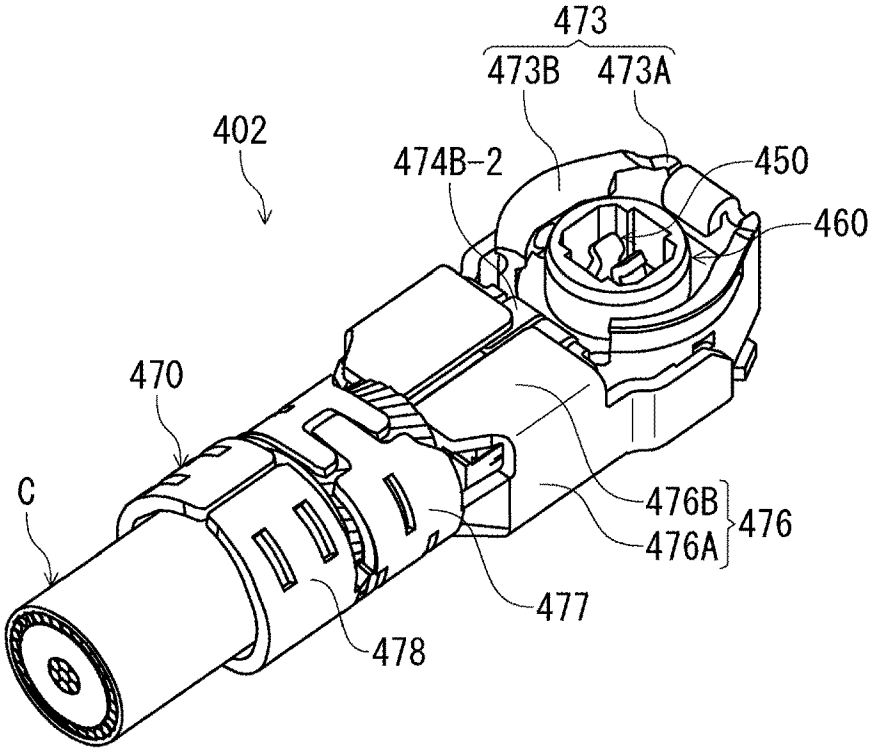
FIG. 18(A) illustrates an oblique view of the plug coaxial electrical connector according to the fifth embodiment.
Figure 19B:
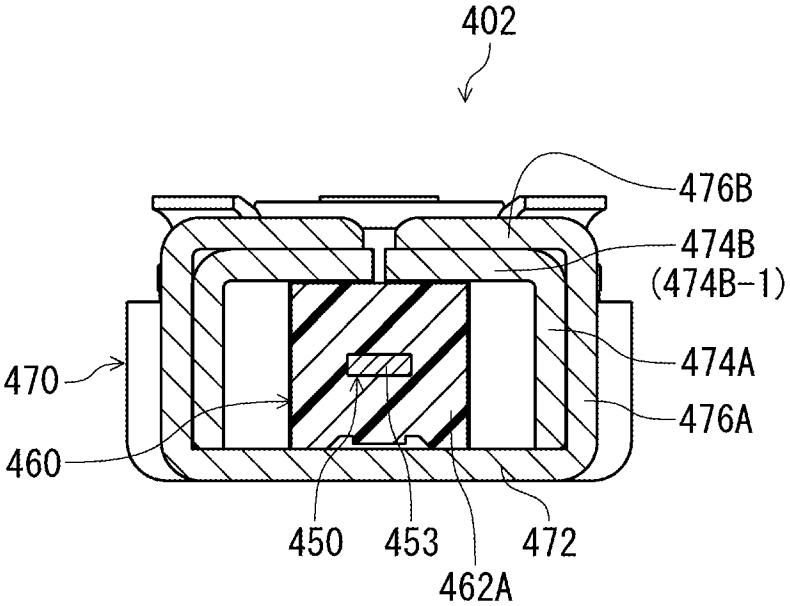
FIG. 19(B) is a cross-sectional view of the plug coaxial electrical connector of (A) taken along line XIXB-XIXB.
Figure 19A:
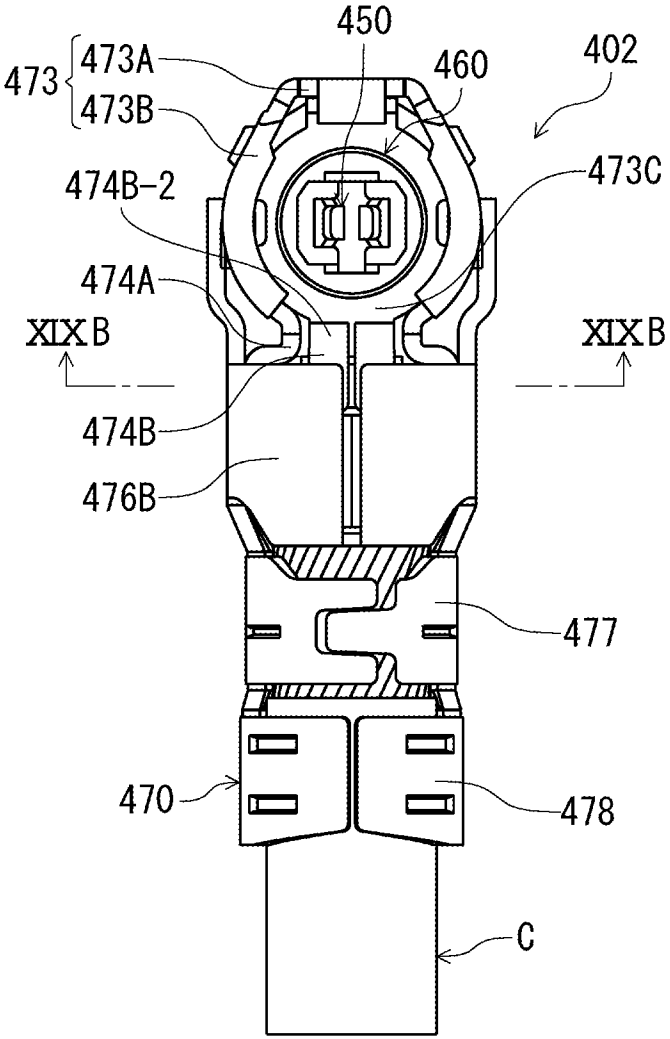
FIG. 19(A) illustrates a plan view of the plug coaxial electrical connector of FIG. 18(A) seen from above.

FIG. 18(A) is an oblique view of the plug connector according to the fifth embodiment, and FIG. 18(B) is an oblique view of a state prior to folding the cover plate portions, shield retaining portions, and cable retaining portions of the plug outer conductor of the plug connector illustrated in FIG. 18(A). FIG. 19(A) is a plan view of the plug connector of FIG. 18(A) seen from above, and FIG. 19(B) is a cross-sectional view of the plug connector of FIG. 18(A) taken along line XIXB-XIXB.

Although in the present embodiment, in the plug outer conductor 470 of the plug connector 402, the mating body portion 473 has a pair of curved plate portions 473B in the same manner as in the first embodiment, as can be seen in FIG. 18(A) and FIG. 19(A), the gap 473C formed between the rear ends of the curved plate portions 473B is larger than the gap 73C in the first embodiment (see FIG. 7 and FIG. 11(A), etc.).

As can be seen in FIG. 18(B), the arm-shaped portions 474, in the same manner as the arm-shaped portions 74 of the first embodiment (see FIG. 10(B)), have base arm portions 474A and resilient arm portions 474B. In the present embodiment, the resilient arm portions 474B are resiliently displaceable in the forward-backward direction, and, as can be seen in FIG. 19(A), the front end portions of the resilient arm portions 474B, i.e., the front contact portions 474B-2 are located within the gap 473C in the circumferential direction of the mating body portion 473. As a result, when the connectors are in a mated state, the front contact portions 474B-2 are enabled to contact the tubular portion 11 of the receptacle outer conductor 10 of the receptacle connector 1 under contact pressure. In addition, in the same manner as the arm-shaped portions 74 of the first embodiment, the resilient arm portions 474B have rear contact portions 474B-1 located rearwardly of the front contact portions 474B-2, and are brought into contact with the end plate portions 476B of the cover plate portions 476 (see FIG. 19(B)).

When the receptacle connector 1 is matingly connected to the plug connector 402 of the present embodiment and, as discussed above, the front contact portions 474B-2 of the plug outer conductor 470 are brought into contact with the tubular portion 11 serving as the counterpart mating body portion of the receptacle outer conductor 10, the tubular portion 11 and the end plate portions 476B are placed in electrical communication via the front contact portions 474B-2 and the rear contact portions 474B-1, thereby forming a return path through the tubular portion 11, resilient arm portions 474B and end plate portions 476B and enhancing shielding properties. In addition, in the present embodiment, shielding properties are further enhanced because the front contact portions 474B-2 are located in the gap between the mating body portion 473 and the end plate portions 476B in the forward-backward direction and cover said gap.

Sixth Embodiment

In the first embodiment, the plug outer conductor 70 of the plug connector 2 had arm-shaped portions 74 that extended from the mating body portion 73, and a return path was formed by bringing the resilient arm portions 74B of said arm-shaped portions 74 into contact with the mating body portion 73 and the end plate portions 76B. By contrast, the present embodiment differs from the first embodiment in that the return path is formed as a result of bringing the contact pieces that extend from the mating body portion into contact with the end plate portions.

The receptacle connector of the present embodiment has the same configuration as the receptacle connector 1 of the first embodiment. In addition, with the exception of the plug outer conductor, the plug connector of the present embodiment has the same configuration as the plug connector of the first embodiment. In the present embodiment, the plug connector is discussed with emphasis on differences from the first embodiment, and parts identical to the respective components used in the first embodiment are assigned numerals obtained by adding "500" to the numerals used in the first embodiment and further discussion thereof is omitted.

Figure 20B:
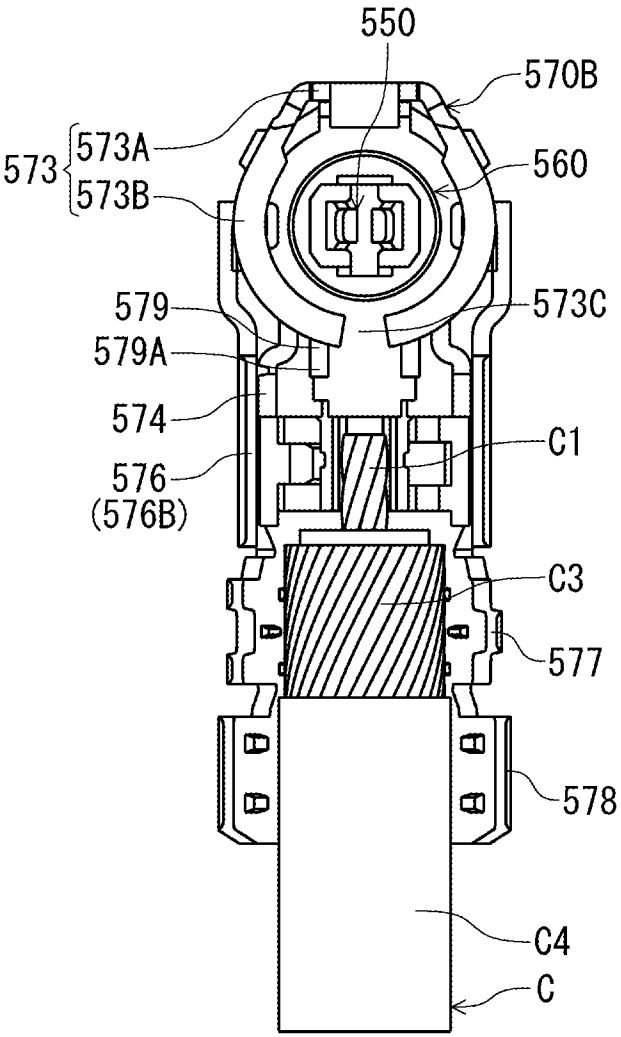
FIG. 20(B) illustrates a plan view of the plug coaxial electrical connector illustrated in FIG. 20(A) seen from above.
Figure 20A:
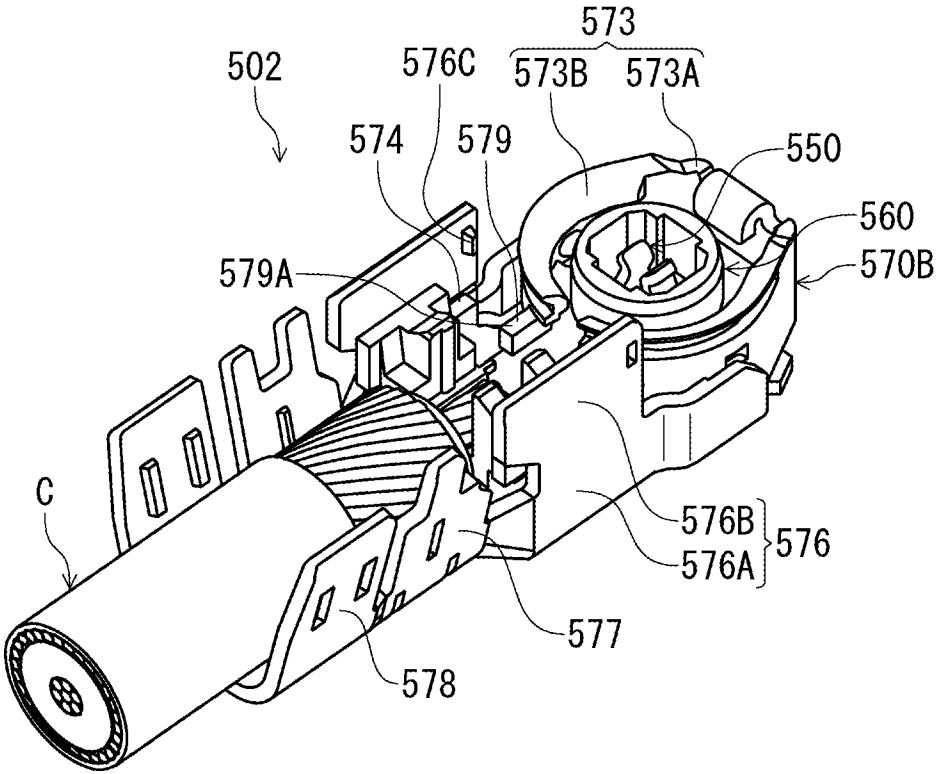
FIG. 20(A) illustrates an oblique view of a state prior to folding the cover plate portions, shield retaining portions, and cable retaining portions of the plug outer conductor of the plug coaxial electrical connector according to the sixth embodiment.
Figure 21C:
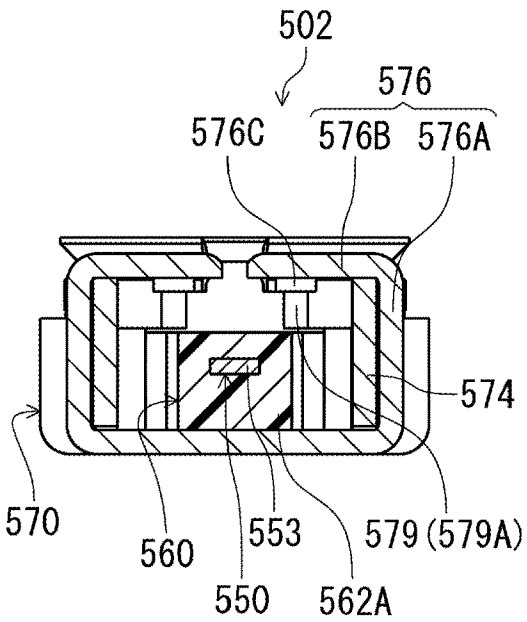
FIG. 21(C) is a cross-sectional view of the plug coaxial electrical connector of FIG. 21(A) taken along line XXIC-XXIC.
Figure 21B:
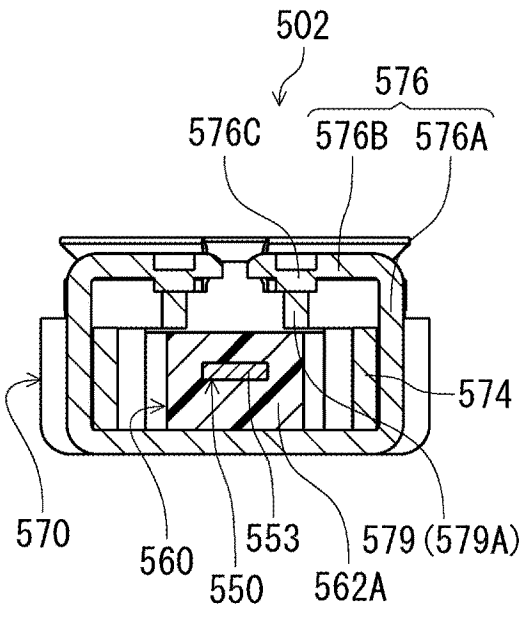
FIG. 21(B) illustrates a cross-sectional view of the plug coaxial electrical connector of FIG. 21(A) taken along line XXIB-XXIB.
Figure 21A:
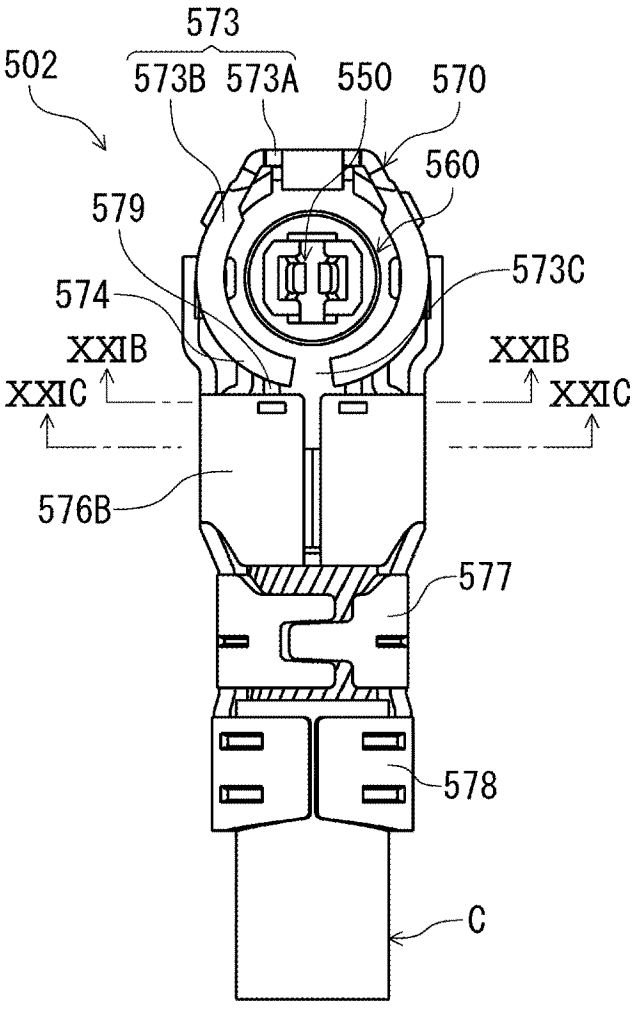
FIG. 21(A) illustrates a plan view of the plug coaxial electrical connector according to the sixth embodiment as seen from above in FIG. 20(A)

FIG. 20(A) is an oblique view of a state prior to folding the cover plate portions 576, shield retaining portions 577, and cable retaining portions 578 of the plug outer conductor 570 of the plug connector 502 according to the present embodiment, and FIG. 20(B) is a plan view of the plug connector 502 of FIG. 20(A) seen from above. FIG. 21(A) is a plan view of the plug connector 502 according to the present embodiment as seen from above in FIG. 20(A), FIG. 21(B) is a cross-sectional view of the plug connector 502 of FIG. 21(A) taken along line XXIB-XXIB, and (C) is a cross-sectional view of the plug connector 502 of FIG. 21(A) taken along line XXIC-XXIC.

In the present embodiment, as can be seen in FIG. 20(A), the plug outer conductor 570 of the plug connector 502 has contact pieces 579 formed by cutting the rear end portions of said curved plate portions 573B and causing them to protrude rearward at intermediate locations of the curved plate portions 573B of the mating body portion 573 in the up-down direction. In addition, instead of parts corresponding to the arm-shaped portions 74 used in the first embodiment, the plug outer conductor 570 has engagement pieces 574 that extend in a crank-like configuration by cutting, and causing to protrude rearward the rear end portions of the curved plate portions 573B at locations below the contact pieces 579.

As can be seen in FIG. 20(B), the engagement pieces 574, which are located outwardly of the contact pieces 579 in the connector width direction, extend rearwardly beyond said contact pieces 579 and reach the bounds of the end plate portions 576B. As can be seen in FIG. 21(C), the rear halves of the engagement pieces 574 are located along the inner surface of the cover plate portions 576 and upwardly extend to the location of the end plate portions 576B. In the forward-backward direction, the rear halves of the engagement pieces 574 are located all the way to the bounds of the end plate portions 576B, thereby allowing said rear halves to engage the end plate portions 576B from below as seen in FIG. 21(C).

When the plug connector 502 mated with the receptacle connector 1 is removed from the receptacle connector 1, the mating body portion 573 of the plug connector 502 is subjected to external forces acting in an opposite direction to the disengagement force (upwards in FIG. 20(A)) as a result of friction, etc., against the tubular portion 11 of the receptacle outer conductor 10. In the present embodiment, the engagement pieces 574 that extend from the mating body portion 573 are located in a manner permitting engagement with the major faces of the end plate portions 576B in the up-down direction. Therefore, during connector removal, said engagement pieces 574 engage the end plate portions 576B, which makes it possible to counteract the external forces with the help of the engagement force to which said engagement pieces 574 are subjected by the end plate portions 576B (force acting in the same direction (downwards in FIG. 20(A)) as the disengagement force) and consequently allows for the plug connector 502 to be removed in a more reliable manner without damaging the connector.

In addition, in the present embodiment, the rear halves of the engagement pieces 574 are located at locations along the rear lateral plate portions 576A, in other words, proximate to the coupling section of the rear lateral plate portions 576A and the end plate portions 576B in the connector width direction. As a result, when the engagement pieces 574 are engaged with the end plate portions 576B during connector removal, the displacement of said end plate portions 576B away from (upwardly in FIG. 21(A)) the junction section in the direction of plugging and unplugging can be minimized.

In addition, the rear end portions of the contact pieces 579 are located within the bounds of the end plate portions 576B in the forward-backward direction. The rear end portions of the contact pieces 579 constitute contact point portions 579A that are located directly below the end plate portions 576B and are brought into contact with the hereinafter-described protrusions 576C of the end plate portions 576B (see FIG. 21(B)).

Protrusions 576C that protrude from the major faces (bottom faces in FIG. 21(B)) of the end plate portions 576B toward the contact point portions 579A, in other words, downwardly as seen in FIG. 21(B), at inward locations in the connector width direction, namely, at locations corresponding to the contact point portions 579A, are formed in the front end portions of the end plate portions 576B (see also FIG. 20(A)). As can be seen in FIG. 21(B) and FIG. 21(C), the protrusions 576C are brought into contact with the contact point portions 579A under contact pressure. Accordingly, bringing the protrusions 576C into contact with the contact point portions 579A can ensure solid contact between the end plate portions 576B and the contact pieces 579.

In the present embodiment, placing the mating body portion 573 and the end plate portions 576B in electrical communication via the contact pieces 579 forms a return path through the tubular portion 11 of the receptacle outer conductor 10, mating body portion 573, contact pieces 579 and end plate portions 576B when the connectors are in a mated state and thereby enhances shielding properties. In addition, since the contact pieces 579 are adapted to be located between the mating body portion 573 and the end plate portions 576B in the forward-backward direction, the gap between the mating body portion 573 and the end plate portions 576B is covered by the contact pieces 579, which enhances shielding properties.

Although in the present embodiment the end plate portions are configured as single plates continuous throughout their entire extent in the forward-backward direction, the shape of the end plate portions is not limited thereto and a number of variations are possible. For example, the end plate portions may be split with slits in the forward-backward direction.

Figure 22B:
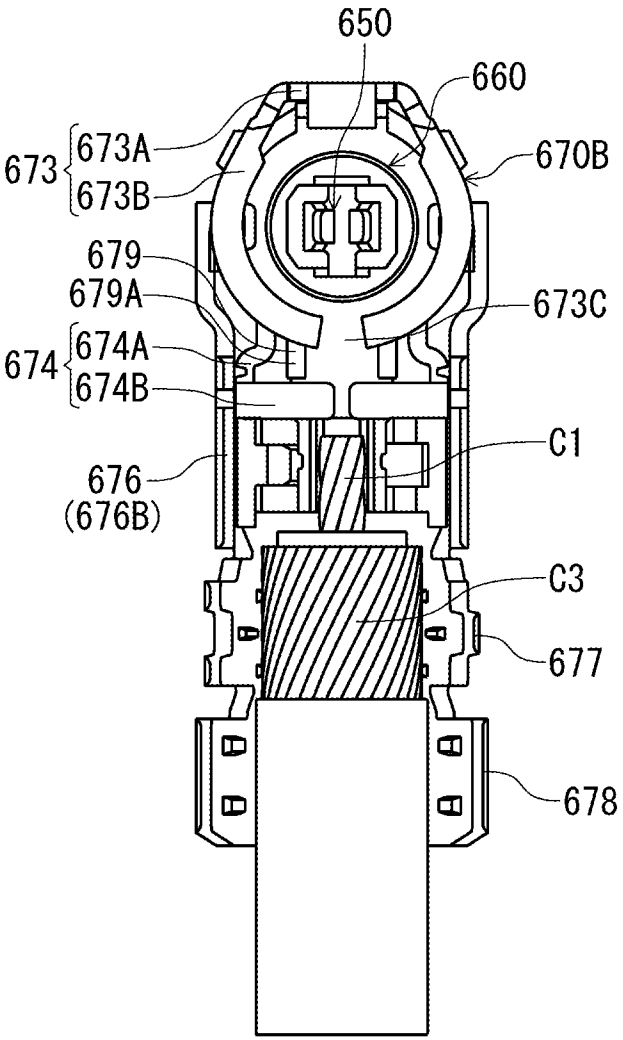
FIG. 22(B) illustrates a plan view of the plug coaxial electrical connector illustrated in FIG. 22(A) seen from above.
Figure 22A:
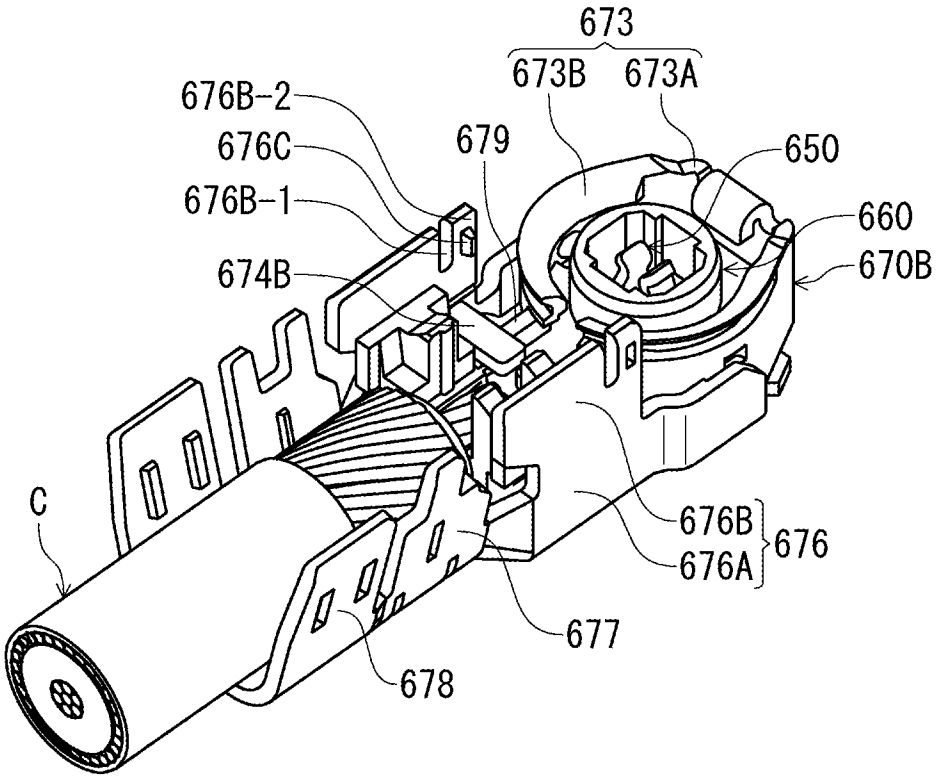
FIG. 22(A) illustrates an oblique view of a state prior to folding the cover plate portions, shield retaining portions, and cable retaining portions of a plug outer conductor in a plug coaxial electrical connector according to a variation of the sixth embodiment.
Figure 23C:
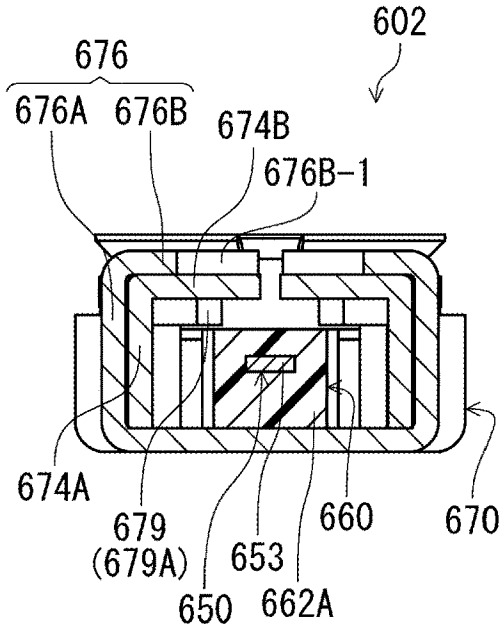
FIG. 23(C) is a cross-sectional view of the plug coaxial electrical connector of FIG. 23(A) taken along line XXIIIC-XXIIIC.
Figure 23B:
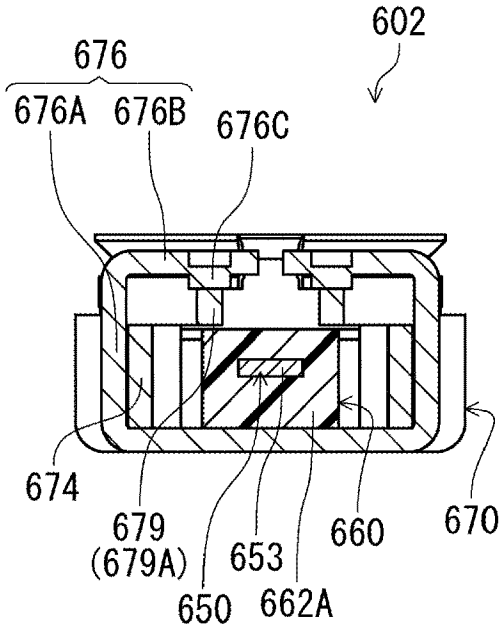
FIG. 23(B) is a cross-sectional view of the plug coaxial electrical connector of FIG. 23(A) taken along line XXIIIB-XXIIIB.
Figure 23A:
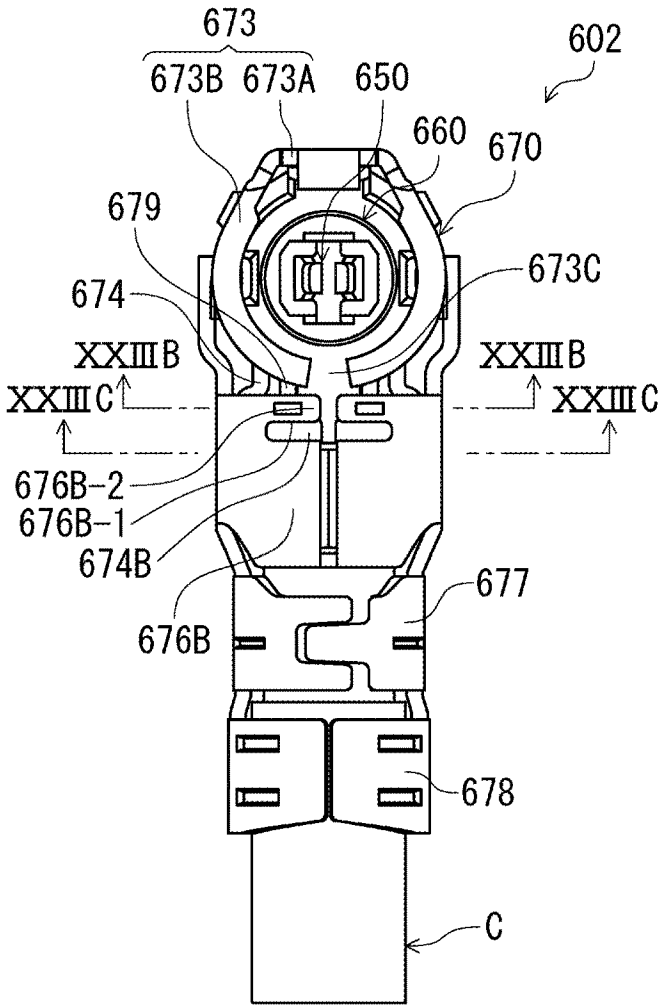
FIG. 23(A) illustrates a plan view of a plug coaxial electrical connector according to a variation of the sixth embodiment as seen from above in FIG. 22(A)

FIG. 22(A) is an oblique view of a state prior to folding the cover plate portions, shield retaining portions, and cable retaining portions of a plug outer conductor in a plug connector according to a variation of the sixth embodiment, and FIG. 22(B) is a plan view of the plug connector of FIG. 22(A) seen from above. FIG. 23(A) is a bottom view of a plug connector according to a variation of the sixth embodiment, FIG. 23(B) is a cross-sectional view of the plug connector of FIG. 23(A) taken along line XXIIIB-XXIIIB, and FIG. 23(C) is a cross-sectional view of the plug connector of FIG. 23(A) taken along line XXIIIC-XXIIIC. In this variation, the plug connector is discussed with emphasis on differences from the above-described sixth embodiment, and parts identical to the respective components used in the sixth embodiment are assigned numerals obtained by adding "100" to the numerals used in the sixth embodiment and further discussion thereof is omitted.

As can be seen in FIG. 23(A), in this variation, the end plate portions 676B have a slit 676B-1 formed on the front end side thereof so as to extend inwardly from an intermediate location in the connector width direction. Resilient pieces 676B-2 that extend inwardly in the connector width direction along the slits 676B-1 and are resiliently displaceable in the up-down direction are formed at locations forward of the slits 676B-1. Protrusions 676C that protrude from the major faces (bottom faces in FIG. 23(B)) of the resilient pieces 676B-2 toward the contact point portions 679A, in other words, downwardly as seen in FIG. 23(B), at inward locations in the connector width direction, namely, at locations corresponding to the contact point portions 679A of the contact pieces 679, are formed in the resilient pieces 676B (see also FIG. 22(A)).

The engagement pieces 674 have base arm portions 674A that extend from the rear end portions of the curved plate portions 673B of the mating body portion 673 in the direction, and inner plate portions 674B that extend inwardly in the connector width direction from the rear end portions of said base arm portions 674A. The inner plate portions 674B are located within a range that includes the slits 676B-1 of the end plate portions 676B both in the forward-backward direction and in the connector width direction. In the present embodiment, the degradation of shielding properties due to the formation of the slits 676B-1 in the end plate portions 676B can be minimized because the slits 676B-1 are blocked (see FIG. 23(A)) by the inner plate portions 674B when the plug connector 602 is viewed in the up-down direction. In addition, in the inner plate portions 674B, the major faces of the sections located within the extent of overlap with the end plate portions 676B at the periphery of the slits 676B-1 when viewed in the up-down direction are brought into contact with the major faces of the end plate portions 676B and thus enabled for electrical communication.

In the present embodiment, the end plate portions 676B have resilient pieces 676B-2 that are located forwardly of the slits 676B-1 and adapted to be resiliently displaced in the up-down direction independently from other components. Therefore, when the protrusions 676C of the slits 676B-1 are brought into contact with the contact pieces 679 under contact pressure and are acted upon by a reaction force originating from said contact pieces 579, the resilient pieces 676B-2 are resiliently displaced in an independent manner, and other components of the end plate portions 676B are not displaced. Therefore, the junction section of the cable C can be kept reliably covered by the end plate portions 676B.

DESCRIPTION OF THE REFERENCE NUMERALS

1 Receptacle connector
2, 102, 202, 302, 402, 502 Plug connectors
10, 310 Receptacle outer conductors
11, 311 Tubular portions
20 Receptacle inner conductor
20P Carrier-equipped inner conductor
21 Upright portion
21A Internal contact portion
22 Projecting portion
22A Connecting portion
30 Internal dielectric body
31 Bottom plate portion
31A Passage portion
32 Standing portion
33 Receiving portion
50 Plug inner conductor
52 Internal contact portion
60 Dielectric body
70, 170, 270, 370, 470, 570 Plug outer conductors
73, 173, 273, 373, 473, 573 Mating body portions
73C, 173C, 473C Gaps
74, 374, 474, 574 Arm-shaped portions
74A, 174A, 474A Base arm portions
74B, 174B, 474B Resilient arm portions
74B-1, 374B-1, 474B-1 Rear contact portions
74B-2, 374B-2, 474B-2 Front contact portions
76, 176, 276, 376, 476, 576 Cover plate portions
76A, 176A, 576A Rear lateral plate portions
76B, 176B, 276B, 376B, 476B, 576B End plate portions
176B-1 Slit
176B-2 Resilient piece
179 Contact piece
179A Front contact portion
280 Intermediate member
281 Main body portion
281A Rear contact portion
282B Front contact piece
576B End plate portion
576C Protrusion
579 Contact piece
579A Contact point portion
B Circuit board
C Cable
P1, P2 Carriers

What is claimed is:

1. A coaxial electrical connector to which the front end portion of a cable extending in a forward-backward direction is connected and which is plugged into and unplugged from a counterpart connector such that a direction of plugging and unplugging is an axial direction of the coaxial connector perpendicular to the forward-backward direction, said connector comprising:

an inner conductor having an internal contact portion that extends in the direction of plugging and unplugging and is enabled to contact a counterpart inner conductor provided in the counterpart connector;

a dielectric body that secures the inner conductor in place; and an outer conductor that accommodates the dielectric body;

wherein the outer conductor comprises a mating body portion that encloses the internal contact portion about an axis extending in the direction of plugging and unplugging and is enabled for mating contact with a counterpart outer conductor provided in the counterpart connector, and cover plate portions that cover a junction section between the inner conductor and the cable at a location rearward of said mating body portion; wherein:

the outer conductor has arm-shaped portions that extend from the mating body portion;

the arm-shaped portions are of a curved shape and have front contact portions enabled to contact the mating body portion and rear contact portions enabled to contact the cover plate portions; and bringing the front contact portions into contact with the mating body portion while bringing the rear contact portions into contact with the cover plate portions places the counterpart outer conductor and the cover plate portions in electrical communication via the mating body portion, front contact portions, and rear contact portions.

2. The coaxial electrical connector according to claim 1, wherein the arm-shaped portions have base arm portions that extend rearwardly from the mating body portion, and, at a location inward of the base arm portions in the connector width direction perpendicular to both the direction of plugging and unplugging and the forward-backward direction, resilient arm portions that are coupled to the rear end portions of the base arm portions and are resiliently displaceable in the forward-backward direction; and the resilient arm portions, along with having the front contact portions in the front end portions of said resilient arm portions, have the rear contact portions at locations rearward of the front contact portions.

3. The coaxial electrical connector according to claim 1, wherein the cover plate portions have lateral plate portions with major faces that are perpendicular to the connector width direction and end plate portions that extend inwardly in the connector width direction from said lateral plate portions and have major faces perpendicular to the direction of plugging and unplugging; and the resilient arm portions have sections that overlap with the end plate portions in the direction of plugging and unplugging as well as in the connector width direction, the rear contact portions are formed in said sections, and contact with the major faces of the end plate portions is made via said rear contact portions.

4. A coaxial electrical connector to which the front end portion of a cable extending in a forward-backward direction is connected and which is plugged into and unplugged from a counterpart connector such that a direction of plugging and unplugging is the axial direction of the coaxial connector perpendicular to the forward-backward direction, said connector comprising:

an inner conductor having an internal contact portion that extends in the direction of plugging and unplugging and is enabled to contact a counterpart inner conductor provided in the counterpart connector;

a dielectric body that secures the inner conductor in place; and an outer conductor that accommodates the dielectric body;

with the outer conductor comprising a mating body portion that encloses the internal contact portion about an axis extending in the direction of plugging and unplugging and is enabled for mating contact with a counterpart outer conductor provided in the counterpart connector, and cover plate portions that cover a junction section between the inner conductor and the cable at a location rearward of said mating body portion; wherein:

the outer conductor has contact pieces that extend from the cover plate portions;

the contact pieces have front contact portions that are enabled to contact the mating body portion or the counterpart outer conductor; and bringing the front contact portions into contact with the mating body portion or the counterpart outer conductor places the counterpart outer conductor and the cover plate portions in electrical communication via the front contact portions.

5. The coaxial electrical connector according to claim 4, wherein the cover plate portions have lateral plate portions with major faces that are perpendicular to the connector width direction perpendicular to both the direction of plugging and unplugging and the forward-backward direction, and end plate portions that extend inwardly in the connector width direction from said lateral plate portions and have major faces perpendicular to the direction of plugging and unplugging;

the end plate portions have formed therein slits that extend in the connector width direction at locations proximate to the front ends of said end plate portions and have resilient pieces that extend along said slits at locations forward of said slits and are resiliently displaceable in the forward-backward direction; and the contact pieces extend forwardly from the resilient pieces.

6. The coaxial electrical connector according to claim 5, wherein the outer conductor has inner plate portions located within a range that includes at least a portion of the slits in the forward-backward direction as well as in the connector width direction, more proximately to the junction section than to the end plate portions in the direction of plugging and unplugging.

7. A coaxial electrical connector to which the front end portion of a cable extending in a forward-backward direction is connected and which is plugged into and unplugged from a counterpart connector such that the direction of plugging and unplugging is the axial direction of the coaxial connector perpendicular to the forward-backward direction, said connector comprising:

an inner conductor having an internal contact portion that extends in the direction of plugging and unplugging and is enabled to contact a counterpart inner conductor provided in the counterpart connector;

a dielectric body that secures the inner conductor in place; and an outer conductor that accommodates the dielectric body;

with the outer conductor comprising a mating body portion that encloses the internal contact portion about an axis extending in the direction of plugging and unplugging and is enabled for mating contact with a counterpart outer conductor provided in the counterpart connector, and cover plate portions that cover a junction section between the inner conductor and the cable at a location rearward of said mating body portion; wherein:

the coaxial electrical connector has a metal intermediate member mounted to the cover plate portions;

the intermediate member has front contact portions enabled to contact the mating body portion or the counterpart outer conductor and rear contact portions enabled to contact the cover plate portions; and bringing the front contact portions into contact with the mating body portion or the counterpart outer conductor while bringing the rear contact portions into contact with the cover plate portions places the counterpart outer conductor and the cover plate portions in electrical communication via the front contact portions and the rear contact portions.

8. The coaxial electrical connector according to claim 7, wherein the cover plate portions have lateral plate portions with major faces that are perpendicular to the connector width direction perpendicular to both the direction of plugging and unplugging and the forward-backward direction, and end plate portions that extend inwardly in the connector width direction from said lateral plate portions and have major faces perpendicular to the direction of plugging and unplugging;

the intermediate member has a main body portion that extends along the end plate portions and contact pieces that extend from the front end of said main body portion;

the front contact portions are formed in the contact pieces; and the rear contact portions are formed in the main body portion.

9. The coaxial electrical connector according to claim 8, wherein the contact pieces are resiliently displaceable in the forward-backward direction and the front contact portions are formed in the front end portions of the contact pieces.

10. A coaxial electrical connector to which the front end portion of a cable extending in a forward-backward direction is connected and which is plugged into and unplugged from a counterpart connector such that the direction of plugging and unplugging is the axial direction of the coaxial connector perpendicular to the forward-backward direction, said connector comprising:

an inner conductor having an internal contact portion that extends in the direction of plugging and unplugging and is enabled to contact a counterpart inner conductor provided in the counterpart connector;

a dielectric body that secures the inner conductor in place; and an outer conductor that accommodates the dielectric body;

with the outer conductor having a mating body portion that encloses the internal contact portion about an axis extending in the direction of plugging and unplugging and is enabled for mating contact with a counterpart outer conductor provided in the counterpart connector, and cover plate portions that cover a junction section between the inner conductor and the cable at a location rearward of said mating body portion; wherein:

the outer conductor has arm-shaped portions that extend from the mating body portion;

the arm-shaped portions are of a curved shape and have front contact portions enabled to contact the counterpart outer conductor and rear contact portions enabled to contact the cover plate portions; and bringing the front contact portions into contact with the counterpart outer conductor while bringing the rear contact portions into contact with the cover plate portions places the counterpart outer conductor and the cover plate portions in electrical communication via the front contact portions and the rear contact portions.

11. The coaxial electrical connector according to claim 10, wherein the arm-shaped portions have base arm portions that extend rearwardly from the mating body portion, and, at a location inward of the base arm portions in the connector width direction perpendicular to both the direction of plugging and unplugging and the forward-backward direction, have resilient arm portions that are coupled to the rear end portions of the base arm portions, extend forward, and are resiliently displaceable in the direction of plugging and unplugging;

the resilient arm portions, along with having the front contact portions in the front end portions of said resilient arm portions, have the rear contact portions at a location rearward of the front contact portions; and the front contact portions extend toward the counterpart connector in the direction of plugging and unplugging and are enabled to contact the counterpart outer conductor at a location outward of the mating body portion in a direction perpendicular to the direction of plugging and unplugging.

12. The coaxial electrical connector according to claim 10, wherein the arm-shaped portions have base arm portions that extend rearwardly from the mating body portion, and, at a location inward of the base arm portions in the connector width direction perpendicular to both the direction of plugging and unplugging and the forward-backward direction, have resilient arm portions that are coupled to the rear end portions of the base arm portions, extend forward, and are resiliently displaceable in the forward-backward direction;

the resilient arm portions, along with having the front contact portions in the front end portions of said resilient arm portions, have the rear contact portions at a location rearward of the front contact portions; and the front contact portions extend forward and are enabled to contact the counterpart mating body portion of the counterpart outer conductor that mates with the mating body portion.

13. The coaxial electrical connector according to claim 11, wherein the cover plate portions have lateral plate portions with major faces that are perpendicular to the connector width direction, and end plate portions that extend inwardly in the connector width direction from said lateral plate portions and have major faces perpendicular to the direction of plugging and unplugging; and the resilient arm portions have sections that overlap with the end plate portions in the direction of plugging and unplugging as well as in the connector width direction, the rear contact portions are formed in said sections, and contact with the major faces of the end plate portions is made is made via said rear contact portions.

14. The coaxial electrical connector according to claim 11, wherein the mating body portion has a gap in a portion of said mating body portion in the circumferential direction; and the front contact portions are located within the gap and are enabled to contact the counterpart outer conductor.

15. A coaxial electrical connector to which the front end portion of a cable extending in a forward-backward direction is connected and which is plugged into and unplugged from a counterpart connector such that the direction of plugging and unplugging is the axial direction of the coaxial connector perpendicular to the forward-backward direction, said connector comprising:

an inner conductor having an internal contact portion that extends in the direction of plugging and unplugging and is enabled to contact a counterpart inner conductor provided in the counterpart connector;

a dielectric body that secures the inner conductor in place; and an outer conductor that accommodates the dielectric body;

with the outer conductor having a mating body portion that encloses the internal contact portion about an axis extending in the direction of plugging and unplugging and is enabled for mating contact with a counterpart outer conductor provided in the counterpart connector, and cover plate portions that cover a junction section between the inner conductor and the cable at a location rearward of said mating body portion, and said outer conductor having contact pieces that extend from the mating body portion; wherein:

the contact pieces have contact point portions that contact the cover plate portions; and bringing the contact point portions into contact with the cover plate portions places the counterpart outer conductor and the cover plate portions in electrical communication via the contact point portions.

16. The coaxial electrical connector according to claim 15, wherein the cover plate portions have lateral plate portions with major faces that are perpendicular to the connector width direction perpendicular to both the direction of plugging and unplugging and the forward-backward direction, and end plate portions that extend inwardly in the connector width direction from said lateral plate portions and have major faces perpendicular to the direction of plugging and unplugging;

the contact pieces extend within the bounds of the end plate portions in the forward-backward direction; and the contact point portions are formed in the rear end portions of the contact pieces and are brought into contact with end plate portions in the direction of plugging and unplugging.

17. The coaxial connector according to claim 16, wherein the end plate portions have protrusions protruding toward the contact point portions in the direction of plugging and unplugging from the major faces of said end plate portions at locations corresponding to the contact point portions and are adapted to contact the contact point portions via said protrusions.

18. The coaxial electrical connector according to claim 16, wherein the outer conductor has engagement pieces that extend rearwardly from the mating body portion and reach the bounds of the end plate portions; and said engagement pieces, which are located more proximately to the junction section than to the end plate portions in the direction of plugging and unplugging, are positioned in a manner permitting engagement with the major faces of the end plate portions from said junction section.

19. The coaxial electrical connector according to claim 18, wherein the engagement pieces are located outwardly of the contact pieces in the connector width direction.

* * * * *